US011471931B2

(12) United States Patent
Matzen et al.

(10) Patent No.: US 11,471,931 B2
(45) **Date of Patent: *Oct. 18, 2022**

(54) LONG-LIFE DIE FOR THE MANUFACTURING OF ELONGATE BODIES

(71) Applicant: Enkotec A/S, Skanderborg (DK)

(72) Inventors: Claus Peter Matzen, Silkeborg (DK); Kenn Christian Prinds, Egtved (DK)

(73) Assignee: Enkotec A/S, Skanderborg (DK)

( * ) Notice: Subject to any disclaimer, the term of this patent is extended or adjusted under 35 U.S.C. 154(b) by 0 days.

This patent is subject to a terminal disclaimer.

(21) Appl. No.: 17/524,661

(22) Filed: Nov. 11, 2021

(65) Prior Publication Data

US 2022/0088669 A1 Mar. 24, 2022

Related U.S. Application Data

(63) Continuation of application No. PCT/EP2021/073975, filed on Aug. 31, 2020.

(51) Int. Cl.

| | |
|---|---|
| ***B21J 13/03*** | (2006.01) |
| ***B21G 3/28*** | (2006.01) |
| ***B21G 3/12*** | (2006.01) |

(52) U.S. Cl.

CPC ..... *B21J 13/03* (2013.01); *B21G 3/12* (2013.01); *B21G 3/28* (2013.01)

(58) Field of Classification Search

CPC ... B21G 3/16; B21G 3/18; B21G 3/28; B21G 3/12; B21G 3/32; B21J 1/02; B21J 1/025

See application file for complete search history.

(56) References Cited

U.S. PATENT DOCUMENTS

| | | | |
|---|---|---|---|
| 10,906,087 | B1 | 2/2021 | Matzen |
| D921,721 | S | 6/2021 | Matzen |

(Continued)

FOREIGN PATENT DOCUMENTS

| | | | | |
|---|---|---|---|---|
| EE | 05812 | B1 | 11/2018 | |
| GB | 252195 | A * | 5/1925 | ..... B21J 13/02 |

(Continued)

OTHER PUBLICATIONS

Charvet, Pierre; International Search Report and Written Opinion of the International Searching Authority, issued in International Application No. PCT/EP2021/073975; dated May 24, 2022; 6 pages.

*Primary Examiner* — Jessica Cahill
*Assistant Examiner* — Bobby Yeonjin Kim
(74) *Attorney, Agent, or Firm* — Ulmer & Berne LLP

(57) ABSTRACT

A die (1) for mounting in an associated die holder (20) for the production of heads on elongate bodies such as nails or screws. The die has a body (2) with a top surface (3) provided with a through-going groove (4) for receiving and holding an elongate body longitudinally in said groove. Furthermore, the die has a recess (5) on one side merging into the groove (4) at one end of the groove (4) suitable for forming the head of a nail or screw. The die has a side surface portion, e.g. conical, shaped for press fit by contact with a corresponding inner surface portion of a bore or hole (30) in the associated die holder. Further, a second side surface portion (9), e.g. a plane portion, of the die serves to engage with a corresponding inner surface portion of the bore or hole of the die holder. Hereby, it is ensured, that angular orientation of the groove (4) is fixed relative to the die holder (20), and it has been proven that the two different side surface portions of the die, e.g. with a conical portion and a plane portion, provides an efficient press fit which ensures a long lifetime of the die. Further, the die is very simple to mount in the die holder, e.g. by hand, and it is (Continued)

simple to eject by a tool. Thus, altogether a highly efficient nail production can be obtained with such die and die holder system.

9 Claims, 17 Drawing Sheets

(56) References Cited

U.S. PATENT DOCUMENTS

| | | | | |
|---|---|---|---|---|
| 11,207,726 | B2 | 12/2021 | Matzen | |
| 2004/0235578 | A1* | 11/2004 | Jensen | B21G 3/00 470/129 |

FOREIGN PATENT DOCUMENTS

| | | | |
|---|---|---|---|
| GB | 252195 | A | 5/1927 |
| KR | 102255937 | B1 | 5/2021 |
| WO | 2020088823 | A1 | 5/2020 |

* cited by examiner

LONG-LIFE DIE FOR THE MANUFACTURING OF ELONGATE BODIES

CROSS-REFERENCE TO RELATED APPLICATIONS

This patent application is a continuation of PCT/EP2021/073975 filed on Aug. 31, 2020, the disclosures of which are hereby incorporated by reference herein in their entirety and made part of the present U.S. utility patent application for all purposes.

FIELD OF THE INVENTION

The present invention relates to a new design of tooling, specifically a die and die ring, for production of elongate bodies, such as nails or screws in a wire-fed nail machine.

BACKGROUND OF THE INVENTION

In an existing nail-machine one of the main issues is the wear and related replacement of dies or holding jaws for production of said nails, especially forming the head on the nail. The machine is continuously fed with a raw material, a wire, which is shaped into nails through pressure from a stamping, rolling or roll forming process which includes two corresponding dies.

In some nail-machines, the dies are fixated, with thread based fastening means, to a rotating ring tool within the nail-machine, the dies arranged around the ring tool. Replacing the dies on a regular basis is a labour intensive task where several fastening elements are involved to fasten each die. Furthermore, tolerances of each of the fastening elements involved in fastening of the die tend to degrade position precision of the die in the die holder, and thus in the end reduce the quality of the nails as well as introducing wear. An example of such nail producing machine can be seen e.g. in EP 1 631 400 B1.

An improved nail-machine can be seen in WO 2020/088823 A1, where the die for forming heads on nails is press fit into holes or bores of the associated die holder, e.g. a tool ring with 40-60 holes or bore for dies. This provides a more time efficient and reliable method of replacing dies, since each single die can rather easily be dismantled from the die holder and replaced in case of damage. Especially, one single die can be replaced without any interference with other dies mounted on the die holder, and the entire die replacement procedure can be performed easily, e.g. by unauthorized persons.

However, still there is a need to further reduce wear of the dies and thereby reduce downtime of the nail-machine and thus yield of the nail-machine due to the time required for replacement of damaged or partly damaged dies without compromising precision in the positioning of the die in relation to the die holder.

OBJECT OF THE INVENTION

In particular, it may be seen as an object of the present invention to provide a die for the manufacturing of heads on elongate bodies that solves the above mentioned problems of the prior art with and reducing down-time and increasing yield from a nail-machine.

SUMMARY OF THE INVENTION

In a first aspect, the invention provides a die for mounting in an associated die holder for the production of heads on elongate bodies, the die comprising:

- a body with a top surface provided with a through-going groove for receiving and holding an elongate body longitudinally in said groove,
- a recess at one end of the groove suitable for forming the head on the elongate body,
- a side surface comprising a first portion with a curved shaped arranged for press fit by contact with a curved portion of an inner surface of a bore or hole in the associated die holder, and
- a stop surface for engaging with a stop part in the hole or bore of the associated die holder, so as to determine a height of the die in relation to the associated die holder, wherein the side surface further comprises a second portion shaped to engage with a corresponding portion of the inner surface of the bore or hole in the associated die holder, in order to guide angular orientation of the groove relative to the associated die holder.

In an embodiment of the invention, the first portion of the side surface of the die has a round shape, such as a circular or cylindrical shape, which may improve the durability of the die, as sharp edges are usually the weakest point, most prone to chipping, when using alloy-steels suitable for tools. In a preferred embodiment, said first portion of the side surface has a conical shape, which has an advantageous shape for press fitting with a corresponding conical bore of an associated die holder.

In a preferred embodiment of the invention, the second portion of the side surface of the die comprises a plane portion serving to engage with a corresponding plane portion of the inner surface of the bore or hole in the associated die holder. This embodiment is particularly advantageous, as the plane portion provides a lock and key feature with a corresponding bore or hole of an associated die holder, thus preventing an operator from inserting the stop surface into said bore or hole. Thus, the flat surface provides an intuitive design for assembly. Furthermore, the plane portion, as per the inventors significant testing, has proven to provide a very durable die, thus saving time and material, when manufacturing nails.

The inventors have tested the die under normal operational conditions. Normal operational conditions is to be understood as operational conditions according to factory required and/or recommended conditions, i.e. wherein the nail manufacturing machine, wherein the die is positioned, is maintained according to factory recommendations and machine parameters are adjusted and set, according to factory recommendations.

The invention introduces a novel die and method for fixing a die in a die holder for the forming of heads on elongate bodies, such as nails or screws. The introduction of the plane side surface portion which engages with a corresponding plane inner surface portion of the bore or hole of the die holder, the angular orientation guiding between die and die holder is handled without requiring any element which increases height of the die, and a limited height of the die helps increasing its stability under normal head forming operations and thereby eliminates or at least reduces problems with damages and wear.

The inventors have realized and verified by tests under normal nail production conditions, that the die according to the first aspect has a surprisingly long lifetime compared to prior art dies, including the dies disclosed in WO 2020/088823 A1. Thus, a nail-producing machine with such dies can be expected to have a very limited downtime, and thus a high yield, since it is only required to very rarely stop nail production due to worn out or damaged head forming dies.

Furthermore, compared to the prior art dies disclosed in WO 2020/088823 A1, the dies according to the present invention are easier to mount, since they have one plane side surface only and can therefore not fit into the bore or hole of the die holder with the recess for head forming to the wrong side. This helps to reduce mounting time and eliminates damages or time spent on operating a nail producing machine with one or more dies with the head forming recess in the wrong position. The plane side surface further provides a clear, visual lock and key indication which provides an operator with an immediate information as to how the die are to be positioned respective to the bore of an associated die holder, when said operator is tasked with e.g. replacing a die in an associated die holder of a nail manufacturing machine.

Still further, compared to the prior art dies disclosed in WO 2020/088823 A1, the dies according to the present invention are easier to manufacture, since the design is simpler and therefore can be performed with fewer manufacturing steps.

Even further, the dies can be designed with a volume of only 40-50% of the prior art dies disclosed in WO 2020/088823 A1. Thus, the die design helps to save a significant amount of material, typically a hard metal alloy. Hereby, the dies according to the invention are therefore also more environmental friendly than the prior art dies.

In the context of the present invention, 'die' is to be understood as a tool or device for imparting a desired shape, form, or finish to a material or for impressing an object or material, such as shaping the head on a nail or screw from a metal wire.

In the context of the present invention, 'recess' is to be understood as a depression into part of a surface, such as, but not limited to, a cleft, cut or cavity. In the context of the recess for forming the head on the elongate body, the recess can be a combination of a cut out for forming a surface, e.g. a plane surface, suitable for forming the head by applying pressure on the end of the elongate body when being held by the groove. Further, the recess may comprise specific features for forming a specific head shape on the elongate body, e.g. a chamfer and/or a round shape etc.

In the context of the present invention, 'head' is to be understood as the uppermost extremity or projecting part of an object.

In the most preferred embodiments, the groove is perpendicular or substantially perpendicular to a central axis through the body between top surface and a bottom surface of the body of the die. In some embodiments, the bottom surface and the stop surface of the die are the same surface, i.e. the bottom surface constitutes the stop surface. Preferably, the groove is perpendicular to the central axis through the body. Especially, a small offset angle of such as 0.1° may be preferred, and thus most preferably, the groove forms an angle of 89.8°-90.2° with the central axis through the body of the die.

In an embodiment of the invention, the elongate body is processed into rivets.

In an embodiment of the invention, the elongate body is processed into spokes, such as, but not limited to, spokes for a bicycle.

In an embodiment of the invention, the wire to be fed into the machine is smooth.

In an embodiment of the invention, the wire to be fed into the machine is profiled, such as a round, square or spline profile.

In an embodiment of the invention, the plane portion of the side surface is parallel with a central axis of the die. This embodiment may be advantageous for further providing strength to the structure of the die, thus providing a more durable die.

In the context of the present invention, the central axis is an axis extending through a bottom plane and a top plane of the die.

In another embodiment if the invention, the plane portion of the die forms an angle of 0.5-2.0° with a central axis of the die. This embodiment may be advantageous for providing press fit of the side surface of said die with respect to a corresponding bore or hole of an associated die holder.

In yet another embodiment of the invention the second portion of the side surface of the die comprises a curved portion serving to engage with a corresponding curved portion of the inner surface or bore in the associated die holder.

In yet another embodiment of the invention, the curved portion of the second portion of the side surface has a different curvature than a curvature of the first portion of the side surface.

In a preferred embodiment of the invention, the second portion of the side surface of the die is arranged for press fit by contact with the corresponding portion of the inner surface of the bore or hole in the associated die holder.

In another preferred embodiment of the invention, the first portion of the side surface of the die has a conical shape, and wherein the conical shaped portion of the side surface forms an angle of 0.5-2.0°, such as 0.8-1.6°, such as 1.0-1.4°, such as 1.1-1.3°, relative to a central axis of the die. The above examples may provide an optimal press fit angle for providing a durable die, i.e. a die that may be operational for more than 2.000 hours, preferably more than 3.000 hours, more preferably for more than 4.000 hours, even more preferably for between 4.500 and 10.000 hours or more.

In an embodiment of the invention, an area of the second portion of the side surface is smaller than an area of the first portion of the side surface, such as the area of the second portion of the side surface being 10-40% of an area of the first portion of the side surface. This embodiment may be particularly advantageous for providing a more durable die.

In a preferred embodiment of the invention, the side surface of the die has chamfered portions, interconnecting said first and second portions of the side surface. In an embodiment of the invention wherein the side surface of the has a first and second portion, the die has a first and second chamfered portion. This embodiment may be advantageous for reducing machining time of both the die and in particular the bore or hole of the associated die holder.

In another preferred embodiment of the invention, the first and second chamfered portions interconnect respective first and second sides of the second portion of the side surface and the first portion of the side surface.

In yet another preferred embodiment of the invention, the chamfered portions extend from a bottom surface or stop surface of the body of the die. This embodiment may be particularly advantageous for reducing machining time of both the die and in particular the bore or hole of the associated die holder. In some embodiments of the invention, the chamfered portions extend from a bottom surface or stop surface to the top surface of the die.

In another embodiment of the invention, the chamfered portions occupy only a part of the side surface between the bottom surface of the body to the top surface of the body, such as 30-80%, or such as 40-70%, of the distance between the bottom surface of the body to the top surface of the body. This embodiment may be advantageous for providing a more durable die.

In an embodiment of the invention, the chamfered portions of the side surface of the die occupy a total of 1-20% of a circumference of the body of the die, such as 2-10% of the circumference of the body.

It is to be understood, that the circumference of the body of the die is to be understood as a total length of the perimeter of the side surfaces of the die, in a plane perpendicular to the central axis and substantially parallel to the top surface of the die, e.g. the circumference of a first and second portion of a side surface of a die with only two side portions.

In a preferred embodiment of the invention, the chamfered portions of the side surface of the die comprise a plane portion. This embodiment may be particularly advantageous for reducing machining time of both the die and in particular the bore or hole of the associated die holder, i.e. by reducing tolerances of said bore or hole with respect to the corresponding die.

In another embodiment of the invention, the chamfered portions comprise a curved portion. This embodiment may be advantageous for providing a more durable die.

In yet another embodiment of the invention, the second portion of the side surface of the die extends from the top surface to a bottom surface and/or stop surface of the body. This embodiment may be advantageous for providing a more durable die as well as a bore or hole within an associated die holder, which is faster to machine.

In an advantageous embodiment of the invention, the recess for forming the head on the elongate body is formed as a recess in an upper part of the second portion of the side surface. In an embodiment of the invention, the second portion of the side surface is substantially flat, extending from a bottom surface of the die to the top surface of the die and wherein the recess is formed in an upper part of the flat surface. This embodiment is particularly advantageous for providing a more durable die, as the inventors have discovered that providing an extending flat surface on a side of the die, corresponding to a pressing surface for forming the head on the elongate body, provides for a stronger and more durable die which does not crack during extensive use, such as within the first 2.000 to 3.000 hours of operation.

In a preferred embodiment of the invention, an axis along the through-going groove is parallel to a normal to a plane portion of the second portion of the side surface.

In the context of the present invention, it is to be understood that a normal is a defining object such an axis or vector that is perpendicular to a given object. For example, the normal line to a plane curve at a given point is the (infinite) line perpendicular to the tangent line to the curve at the point.

In a preferred embodiment of the invention, the groove on the top surface of the die is perpendicular or substantially perpendicular to a central axis of the die.

In an advantageous embodiment, a bottom surface of the body forms the stop surface.

In a more advantageous embodiment of the invention, bottom surface has a plane portion serving as a stop surface. This embodiment is particularly advantageous for providing a more simple die and corresponding die holder, which are faster and more simple to manufacture.

In an embodiment of the invention, the die further comprises a dummy element or an associated dummy element, such as a monolithic element, arranged for position at a bottom part of the hole or bore of the associated die holder, wherein the dummy element comprises a top surface arranged to engage with a bottom surface of the body of the die, so as to form the stop surface in cooperation with the bottom part of the hole or bore of the associated die holder.

In an advantageous embodiment, a bottom surface or stop surface of the die has a groove, so as to allow an associated tool to engage with the groove in order to push the die upwards for removal of the die from an associated die holder.

In an embodiment of the invention, the bottom or stop surface of said die has an inclined groove so as to ease the extraction or ejection of said die when seated in an associated die holder, when applying pressure with an elongate tool, such as a pin, preferably with a inclined tip corresponding to the inclination of the groove thereby driving the die out of the associated die holder without damaging said die holder or the associated elongate tool.

In a preferred embodiment of the invention, the groove is an inclined groove with an inclination angle between 2° to 20° relative to a bottom surface of the die.

In another embodiment of the invention, the inclined groove on the stop surface of the die has an angle between 1° to 40°, such as between 2° to 30°, such as 5° to 20° or such as 8° to 15°, relative to the stop surface of the die, wherein the angle reduces the pressure needed to extract said die from an associated die holder.

The above embodiments are advantageous, as an inclined groove at a bottom or stop surface of the die may provide easier extraction or ejection of said die when seated in an associated die holder, when applying pressure with an elongate tool, such as a pin, preferably with a inclined tip corresponding to the inclination of the groove thereby driving the die out of the associated die holder without damaging said die holder or tool.

In the context of the present invention, inclined groove is to be understood as a narrow cut or low area in a surface angled from one area in said surface to another area in said surface and wherein the groove varies in depth, relative to said surface from one end of the groove to the opposite end of the groove.

In some embodiments of the die, the stop surface and the bottom surface are one and the same. In some embodiments, the stop surface may be a recess cut into the body of the die at a position above the bottom surface.

In an embodiment of the invention, the inclined groove on the bottom or stop surface of the die has a width (W) and the die has an outer diameter (D), and where a ratio (W/D) between said width and said outer diameter is between 0.01 and 1, more preferably between 0.1 and 0.5 as these ratios may be ideal for the production of dies from steel, such as from tool grade steel or other hard alloys, especially such as a hard metal, e.g. tungsten carbide, or other hard materials suitable for the production of elongate bodies, such as a nail or screw.

In a preferred embodiment of the invention, the inclined groove has a width (W) and the die has an outer diameter (D), and where a ratio (W/D) between said width and said outer diameter is between 0.1 and 0.5.

In another embodiment of the invention, the inclined groove has at least a plane surface part. This embodiment may be advantageous for reducing friction between an associated elongate tool and the plane surface, thereby easing the ejection of the die from die holder, when said die is firmly seated in said die holder.

In an embodiment of the invention, the groove is a plane surface being parallel with an axis perpendicular to a central axis of the die, so as to ease the insertion of an associated elongate tool for the ejection of the die from die holder, when said die is firmly seated in said die holder.

In an embodiment of the invention, the plane surface has an inclination angle of 0.5° to 50°, such as 1° to 40° or such as 2° to 20° relative to the stop surface or bottom surface of the die.

In an embodiment of the invention, the inclined groove has at least a curved surface part.

In the context of the present invention, it is to be understood that the associated elongate tool may be used as a wedge, wherein the tip of said elongate tool is wedged between a bottom surface of the die and the bottom surface of the associated die holder, so as to apply a pressure for pushing the die upwards and out of the bore or hole in the associated die holder.

In an embodiment of the invention, the tip on the associated elongate tool has an inclined flat surface arranged for engagement with an inclined flat surface of the inclined groove of the die, so as to ease the ejection of said die seated in the associated die holder.

In another embodiment of the invention, the groove of the bottom surface is parallel with the through-going groove of the top surface.

In yet another embodiment of the invention, the groove of the bottom surface forms a recess in a bottom part of the second portion of the side surface.

In yet another embodiment of the invention, the body of the die has a symmetry plane, which is parallel with an axis along the through-going groove.

In a preferred embodiment of the invention, the body of the die is monolithic and made of a metal or a ceramics. This embodiment is particularly advantageous for providing a stronger and more durable die, which is faster to manufacture. In general, the die can be formed by a variety of material including metals, alloy steels as well as non-metals.

In the context of the present invention, 'alloy steels' is to be understood as steels that are well-suited to be made into tools. Alloying elements such as, but not limited to Tungsten, Chromium, Vanadium or Molybdenum are added, forming carbides in the steel, to increase the hardness, corrosion and heat resistance, abrasiveness and deformation of the steel.

In an embodiment of the invention, at least a part of the die could be made from cemented carbide, or a ceramic, such as Oxide ceramics with e.g. Zirconia additives, mixed ceramics with e.g. carbides or Silicon nitride ceramics and SiAlON grade ceramics. Ceramics have excellent wear resistance which could improve the durability of the die or the die holder.

In a preferred embodiment of the invention, an outer diameter (D) and an overall height (H) of said die has a ratio between 0.5 and 2.0, such as between 0.7 and 1.5.

In another preferred embodiment of the invention, the height of the die between the top surface and a bottom surface is 5-20 mm, such as 8-18 mm, such as 10-16 mm, such as 12-15 mm.

In yet another preferred embodiment of the invention, the overall length of the through-going groove of the top surface of the die is 5-30 mm, such as 10-20 mm, such as 10-18 mm, such as 10-17 mm or such as 11-17 mm.

In yet another preferred embodiment, the through-going groove on the top surface of the die has a width of 1.2-5.5 mm or such as 1.8-4.5 mm.

In an embodiment of the invention, at least a part of the body of the die, such as the first portion of the side surface of the die, is tapered, improving the fixation of the die within the die holder, i.e. providing a die, which is suitable for press-fit in a die holder with a corresponding tapered geometry. In some embodiments, the tapered part of the body of the die or the entire body of the die may have one or more a circular cross sections. It is to be understood that the circular cross section may likewise be slightly elliptic or slightly oval.

In a preferred embodiment of the invention, first portion of the side surface has a conical shape and occupies more than 180°, such as 200-280°, such as 230-260°, such as 240-250°, of an angular portion of a cross sectional area of the die.

In an embodiment of the invention at least a part of the body of the die has a conical shape, such as wherein a side surface of said part of the body providing an angle of 0.1°-3°, such as 0.5°-2.5°, such as 1.0°-2.0°, with a central axis of the body.

In an embodiment of the invention, the top surface of the die and the surface part of the associated die holder are to be substantially parallel in respect to each other when the stop surface of the die is abutting said bottom surface or lower shoulder surface of the associated die holder.

In an embodiment of the invention, the outer diameter (D) of the die and an overall height (H) of the die has a ratio (D/H) between 0.1 and 5, preferably between 0.5 and 2.0, even more preferably between 0.5 to 1.0, even more preferably between 0.7 to 1.0, even more preferably between 0.8 to 1.0 and even more preferably between 0.9 to 1.0, to optimize manufacturing costs of the die and an associated die holder, such as a tool ring.

In a second aspect, the present invention relates to a die holder comprising:

a body having a surface part, a plurality of holes or bores in the surface part, wherein each of the plurality of holes or bores has a first inner side surface portion with a curved shaped and arranged for receiving a die and for press fit engagement with the die by contact with a side surface of the die, wherein each of the holes or bores has a second inner side surface portion serving to engage with a corresponding side surface portion of the die, in order to fix angular orientation of the die relative to the die holder, and wherein in each of the holes or bores has a stop part arranged to fix a height of a top surface of the die in relation to the surface part of the die holder.

In the context of the present invention, 'press fit' is to be understood as the fit of a body driven into a hole slightly smaller than itself to be held tight and motionless or substantially motionless.

In a preferred embodiment if the invention, the die holder is ring-shaped.

In another preferred embodiment of the invention, the plurality of holes or bores have parallel central axes and radially distributed on the die holder.

In yet another preferred embodiment of the invention, the die holder comprises at least 10 holes or bores, such as 20-60 holes or bores, evenly distributed on a ring-shaped top surface part of the die holder. This embodiment is particularly advantageous for ensuring structural integrity of said die holder.

In some embodiment of the invention, the die holder comprises at least 10 holes or bores evenly distributed on the ring-shaped top surface part, such as 10-100 holes or bores, so as to maximize the amount of said bores or holes on said ring-shaped top surface. In specific embodiments, the die holder may have such as 24, 30, 36, 40, 48, or 60 holes or bores evenly distributed on the ring-shaped top surface part of the die holder, however other numbers of holes or bores may be preferred.

In a preferred embodiment of the invention, the plurality of holes or bores are axially distributed on an inner or outer surface part of the die holder.

In an advantageous embodiment of the invention, the body of the die holder is monolithic and made of a metal.

In another advantageous embodiment of the invention, each of the plurality of holes or bores of the die holder has a conical shaped inner surface portion with an angle of 0.5-2.0° relative to a central axis of the hole or bore. This embodiment of the invention is particularly advantageous for providing a bore, which is suitable for press fit, when inserting an element into said bore, which has a corresponding conical shape, such as the die according to the first aspect of the invention.

In a preferred embodiment of the invention, each of the plurality of holes or bores has a plane inner side surface portion. This embodiment of the invention is particularly advantageous for providing a die holder, which is fast to manufacture while still maintaining a sufficient fixation of an element inserted into said hole or bore, such as the die according to the first aspect of the invention.

In an embodiment of the invention, the plane inner side surface portion is parallel with a central axis of the hole or bore.

This aspect of the invention is particularly, but not exclusively, advantageous in that the die holder according to the present invention may be implemented by insertion in an older, less advanced machine, such as a nail manufacturing machine, as an upgrade kit. The invention is advantageous for new nail or screw manufacturing machines, as well as existing machines which can be modified or updated to include a die holder with dies according to the first aspect of the invention.

In a third aspect, the invention relates to a machine for producing heads on elongated bodies, the machine comprising

- at least one die according to the first aspect of the invention, and
- a die holder according to the second aspect of the invention.

In a preferred embodiment of the invention, a top surface part of the die holder is ring-shaped, having a central axis of rotation, the ring-shaped die holder being mounted so as to rotate about said axis.

In another preferred embodiment of the invention, the top surface of the ring-shaped circular die holder has a plurality of holes or bores, arranged for mounting of respective dies.

In an embodiment of the invention, the top surface of the ring-shaped circular die holder has a plurality of holes or bores, such as 10-100 holes or bores, arranged for mounting of respective dies according to the first aspect of the invention.

In an embodiment of the invention, the plurality of holes or bores are parallel and evenly distributed around the top surface part of the ring-shaped die holder.

In an embodiment of the invention, the machine has two opposite ring-shaped die holders, the die holders angled or slanted so as to, when rotating, to bring two opposite dies close enough together to almost brush against each other.

In an advantageous embodiment of the invention, the die holder body has an opening, connected to a part of the hole or bore shaped for receiving and holding the die, so as to allow an elongate tool to engage with a lower part of the die to push the die upwards for removal of the die from the die holder.

In an embodiment of the invention, the die holder body has an opening, such as a hole or bore, connected to a bottom part of the hole or bore shaped for receiving and holding the die, so as to allow an associated elongate tool to engage with a lower part of the die to push the die upwards for removal of the die from the die holder, such as by exerting a force between the bottom surface of the die and a surface of the die holder. This embodiment is particularly, but not exclusively, advantageous for fast and simple removal of a worn-down or chipped die from the die holder, which will could significantly reduce the downtime of a machine.

In another embodiment of the invention, the die holder is ring-shaped, and wherein said opening is located on an inner side of the ring, so as to allow removal of the die, when the die holder is mounted for normal operation.

In an embodiment of the invention, the opening, for the insertion of the associated elongate tool into the die holder body, is a hole or bore perpendicular to the hole or bore for receiving and holding the die.

In a preferred embodiment of the invention, the machine comprises a head forming mechanism arranged to apply a force onto the elongate body at the recess end of the groove of the die, when the elongate body is fixated by the groove of the die, so as to form a head on the elongate body shaped according to the recess of the die.

In another preferred embodiment of the invention, the first portion of the side surface of the at least one die has a conical shape, wherein the conical shaped portion of the side surface forms a first angle relative to a central axis of the die, and wherein each of the plurality of holes or bores of the die holder has a first inner side surface portion with a conical shape which forms a second angle relative to a central axis of the holes or bores.

In an embodiment of the invention, the first and second angles differ by less than 0.02°.

In another embodiment of the invention, the first angle is larger than the second angle, such as the first angle being 0.02°-0.10° larger than the second angle.

In yet another embodiment of the invention, both of the first and second angles are within 0.5-2.0°, such as 0.8-1.6°, such as 1.0-1.4°, such as 1.1-1.3°.

In a preferred embodiment of the invention, the second portion of the side surface of the at least one die comprises a plane portion, and wherein the second inner side surface portion of the holes or bores of the die holder comprise corresponding plane side surface portions.

In an embodiment of the invention, the plane portion of the at least one die is parallel with a central axis of the at least one die, and wherein said plane side surface portions of the inner side surface of the holes or bores of the die holder are parallel with a central axis of the holes or bores of the die holder.

In an advantageous embodiment of the invention, a bottom surface of the at least one die forms said stop surface of the at least one die, and wherein a bottom surface of the holes or bores of the die holder form said stop part in the holes or bores of the die holder.

In some embodiments of the invention, the machine comprises a dummy element arranged between a bottom surface of the at least one die and a bottom surface of the holes or bores of the die holder. This embodiment of the invention may be advantageous for providing a more durable die within the nail manufacturing machine.

In a preferred embodiment of the invention, a distance between a bottom surface and the top surface of the at least one die is equal to a distance between a bottom surface of the holes or bores and a surface part of the die holder.

The machine may especially be a nail producing machine, such as for producing nails with round heads, or for producing nails with D-shaped heads. The machine may alternatively be a screw producing machine, e.g. for producing heads on threaded elongate bodies.

In a fourth aspect, the invention relates to a die for the manufacture of heads on elongate bodies, such as nails, in a machine according to the third aspect of the invention.

In a fifth aspect, the invention relates to a die holder for the manufacture of heads on elongate bodies, such as nails, in a machine according to the third aspect of the invention.

This aspect of the invention is particularly, but not exclusively, advantageous in that the method according to the present invention may be implemented by inserting a die holder according the second aspect, in an older, less advanced machine, such as a nail manufacturing machine, as an upgrade kit. The invention is advantageous for new nail or screw manufacturing machines, as well as existing machines, which can be modified or updated to include a die holder with dies according to the first aspect of the invention.

In a sixth aspect, the invention relates to a method for manufacturing a head on an elongate body using the die according to the first aspect of the invention.

In a preferred embodiment of the invention, the method comprises mounting the die in a hole or bore of a die holder by means of press fitting, and forming the head of the elongate body with the die, when the die is mounted in the die holder.

In another preferred embodiment of the invention, the method comprises mounting the die in the hole or bore of the die holder in a tool-less mounting process. This embodiment is particularly advantageous for easy and fast fixation of the die within the die holder.

In the context of the present invention, tool-less is to be understood as a method wherein a die can be inserted into the bore of a die holder without the use of any other tools, than the hands of an operator. I.E., the operator does not need a hammer, measuring tool or any other tools, to successfully complete the mounting process.

In yet another preferred embodiment of the invention, the method comprises operating a machine to produce heads on elongate bodies using the die mounted in the die holder in a second step, after mounting the die in the hole or bore without the use of tools, in a first step. This embodiment is particularly advantageous for the production of nails, the process of inserting a new die into the hole or bore of a die holder is fast and only requires few steps, e.g. two steps, after which the production of nails can immediately continue.

It is to be understood that any service hatches needs to be opened/closed before/after the insertion of any dies.

In an embodiment of the invention, the method comprises:

a. providing (S1) first and second die holders, each of the first and second die holders comprising:
   i. a body having at least a surface part,
   ii. a hole or bore in the surface part, wherein the hole or bore has a first inner surface portion with a curved shaped and arranged for receiving the die and for press fit by contact with a first side surface portion of the die,
   iii. a stop part located in the hole or bore for engaging with a bottom surface of the die when being pressed into the hole or bore, so as to fix a height of the top surface of the die in relation to the surface part of the die holder, and
   iv. a second inner surface portion of the bore or hole engaging with a corresponding second side surface portion of the die, in order to fix angular orientation of the groove of the die relative to the die holder,
b. providing (S2) first and second dies, each of the first and second dies comprising:
   i. a body with a top surface provided with a through-going groove for receiving and holding an elongate body longitudinally in said groove,
   ii. a recess at one end of the groove suitable for forming the head on the elongate body,
   iii. a first side surface portion with a curved shape for press fit by contact with a first inner surface portion of a bore or hole in the associated die holder,
   iv. a stop surface for engaging with a stop part in the hole or bore of the associated die holder, so as to determine a height of the top surface of the die in relation to a surface part of the associated die holder, and
   v. a second side surface portion serving to engage with the corresponding second inner surface portion of the die holder, in order to fix angular orientation of the groove relative to the die holder,
c. bringing (S3) the top surface of the first die so near to the top surface of the second die that the grooves of the first and second dies hold the elongate body, and
d. providing (S4) force onto the elongate body at the recess end of the grooves so as to form a head on the elongate body.

In an embodiment of the invention, the method comprises ejecting the die from a hole or bore in a die holder.

In an embodiment of the invention, the method comprises:

providing an elongate tool, such as a pin, inserting said elongate tool into an opening of the associated die holder, and applying a force in a length axis of the elongate tool towards the die so as to force said die to eject from the die holder, in a direction substantially perpendicular to the direction of the applied force.

This embodiment of the invention is particularly, but not exclusively, advantageous in that the method according to the present invention may be implemented by using an elongate tool in combination with the die according to the first aspect of the invention and the die holder according to the second aspect, in an older, less advanced machine, such as a nail manufacturing machine, as an upgrade kit. The invention is advantageous for new nail or screw manufacturing machines, as well as existing machines, which can be modified or updated so as to faster replace any damaged dies from the die holder and hence, reduce down time on the manufacturing machine.

In another embodiment of the invention, the method comprises engaging between a tip of the elongate tool and a groove in a bottom part of the die, wherein said tip and said groove are shaped to match so as to facilitate ejection of the die.

This aspect of the invention is particularly, but not exclusively, advantageous in that the method according to the present invention may be implemented by providing a ring shaped die holder according to the second aspect and the die according the first aspect. The invention is advantageous for new nail or screw manufacturing machines, as well as existing machines, which can be modified or updated to include a die holder with dies according to the invention.

In a seventh aspect, the invention relates to a method for manufacturing a head on an elongate body, such as a nail, using the die holder according to the second aspect of the invention.

In an eighth aspect, the invention relates to a method for manufacturing a head on an elongate body, such as a nail, using the machine according to the third aspect of the invention.

In a ninth aspect, the invention relates to a method of manufacturing nails comprising:

1) press fitting, by contact, a first side surface portion with a curved shape of the die with a curved second inner surface portion of a hole or bore in a die holder,
2) engaging a stop surface of the die with a stop part in the hole or bore of the die holder, so as to determine a height of the die in relation to the die holder,
3) fixing angular position of the die relative to the die holder by engaging a second side surface portion, such as a plane side surface portion, of the die with a corresponding second inner surface portion of the hole or bore in the die holder, after steps 1), 2) and 3), receiving and holding an elongate body longitudinally in a groove on a top surface of a die, and forming a head on an elongate body via a recess at one end of the groove of the die.

In an tenth aspect, the invention relates to a nail manufactured according to any one of the sixth to ninth aspect of the invention.

In an eleventh aspect, the invention relates to the use of a die according to the first aspect of the invention, for manufacturing a head on an elongate body, such as a nail.

In a twelfth aspect, the invention relates to the use of a die holder according to the second aspect of the invention, for manufacturing a head on an elongate body, such as a nail.

In a thirteenth aspect, the invention relates to the use of a machine according to the third aspect of the invention, for manufacturing a head on an elongate body, such as a nail.

In a fourteenth aspect, the invention relates to a method of forming a manufacture comprising:

mounting a die in an associated die holder for the production of heads on elongate bodies, receiving and holding an elongate body longitudinally in a groove through a top surface of the die, forming a head on the elongate body at a recess of one end of the groove, press fitting a first side surface portion with a curved shape of the die by contact with a first inner surface portion of a bore or hole with a curved shape in the associated die holder, engaging a second side surface portion, such as a plane portion, of the die with a second inner surface portion of the bore or hole in the associated die holder so as to fix angular orientation of the groove relative to the associated die holder, and engaging a stop surface of the die with a stop part in the hole or bore of the associated die holder, so as to determine a height of the die in relation to the associated die holder.

The first, second, third, fourth, fifth, sixth, seventh, eighth, ninth, tenth, eleventh, twelfth, thirteenth and fourteenth aspect of the present invention may each be combined with any of the other aspects. These and other aspects of the invention will be apparent from and elucidated with reference to the embodiments described hereinafter.

BRIEF DESCRIPTION OF THE FIGURES

The die according to the invention will now be described in more detail with regard to the accompanying figures. The figures show one way of implementing the present invention and is not to be construed as being limiting to other possible embodiments falling within the scope of the attached claim set.

DETAILED DESCRIPTION OF EMBODIMENTS

Figure 1:
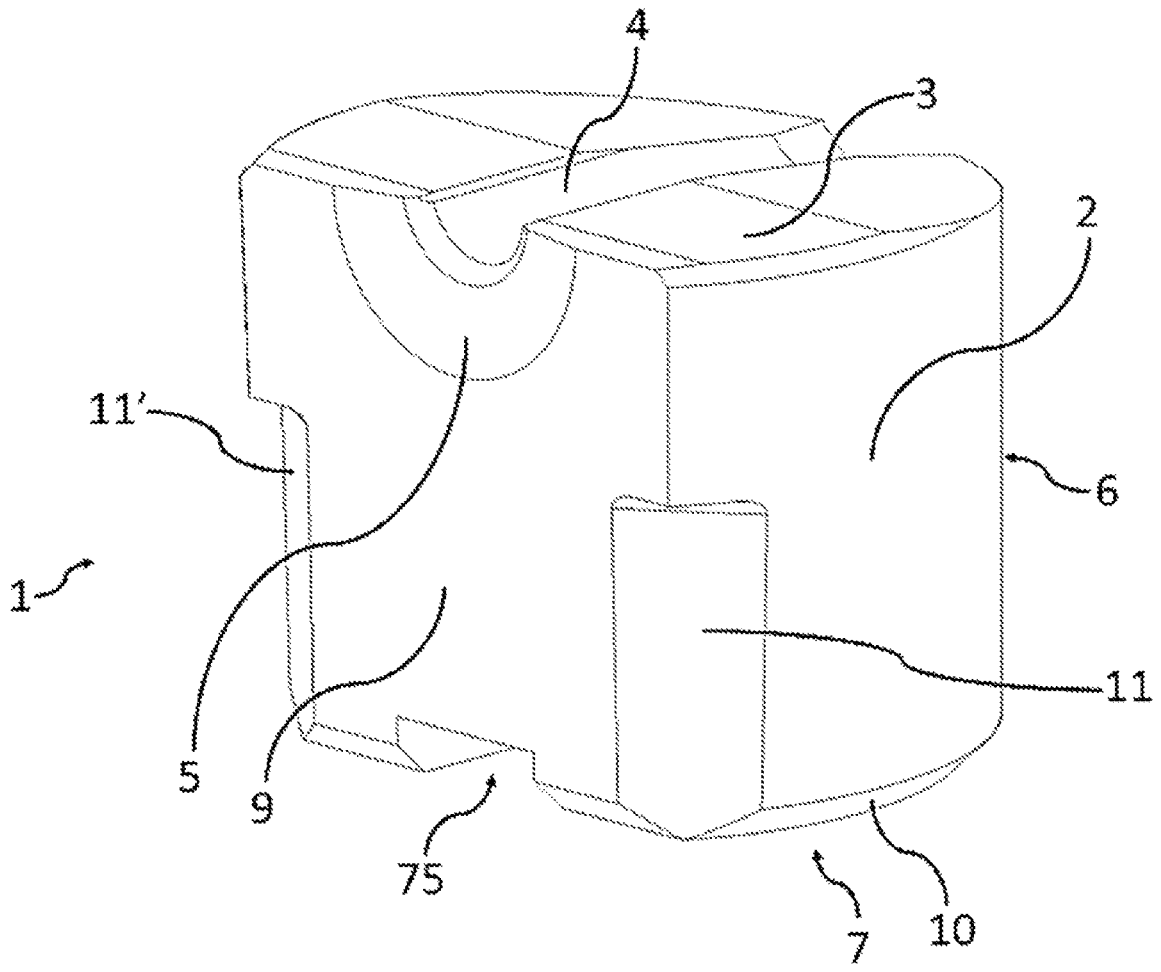
FIG. 1 is a trimetric view of a die embodiment.

FIG. 1 is a trimetric view of a die 1 embodiment. The figure illustrates a die 1 for mounting in an associated die holder (not shown) for the production of heads on elongate bodies, such as a metal nail or screw. The die 1 comprises a body 2 with a top surface 3. The top surface has a through-going groove 4 suitable for receiving and holding the elongate body longitudinally in the groove 4. The groove 4 may have gripper marks (not visible) for increased friction with the elongate body to improve the holding effect. The body 2 of the die 1 has a side surface 6 comprising a first, substantially round portion and a second portion 9. The second portion 9 has a recess 5, which extends from the second portion 9 and merges into the groove 4. The recess 5 is shaped to form half of the head on the elongate body. The side surface 6 is shaped for press fit by contact with an inner surface of a bore or hole in the associated die holder. The die 1 has a bottom surface 7 with a chamfer 10 for easy mounting of the die 1 into the hole or bore of the associated die holder. The second portion 9 of the side surface 6 is flat for higher durability and furthermore serves to engage with a corresponding flat surface of the associated die holder, in order to fix angular orientation of the groove 4 relative to the associated die holder. On the side surface 6 of the body 2 of the die 1, a first chamfered portion 11 and a second chamfered portion 11' is positioned, interconnecting the first portion of the side surface 6 with the second portion 9. In some embodiments of the die 1, the first and second chamfered portions 11, 11' extends from the bottom surface 7 to the top surface 3 of the die 1. On the bottom surface 7, a groove 75 has been cut into the body 2 of the die 1, extending from the bottom surface 7 to the second portion 9 of the side surface 6. The purpose of this groove 75 is to allow an associated elongate tool (not shown) with a tip matching the groove 75 to engage with the groove in order to push the die 1 upwards, when press fit mounted in an associated die holder 20. Especially, such elongate tool can be inserted in an opening in the associated die holder 20 and thus facilitate removing the die for replacement.

Figure 2:
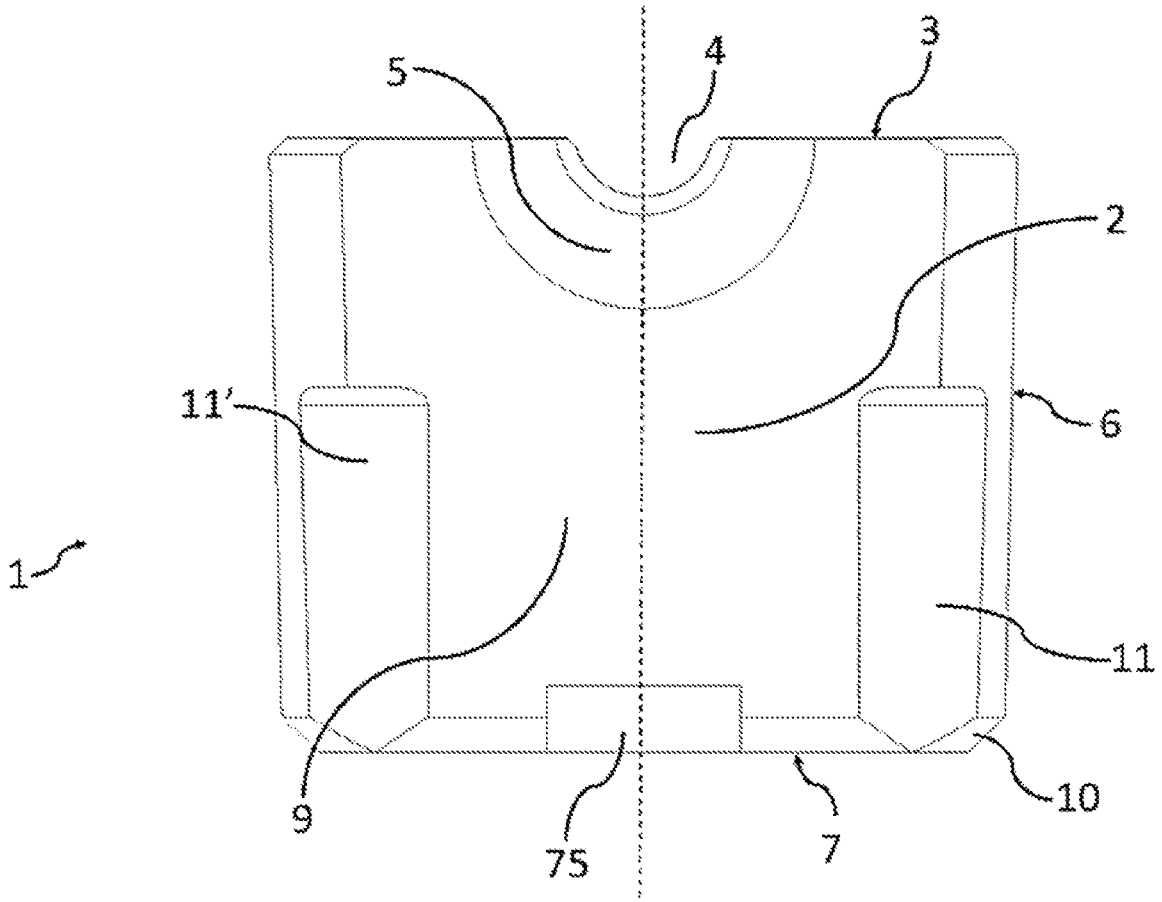
FIG. 2 is a frontal view of a die embodiment.
Figure 3:
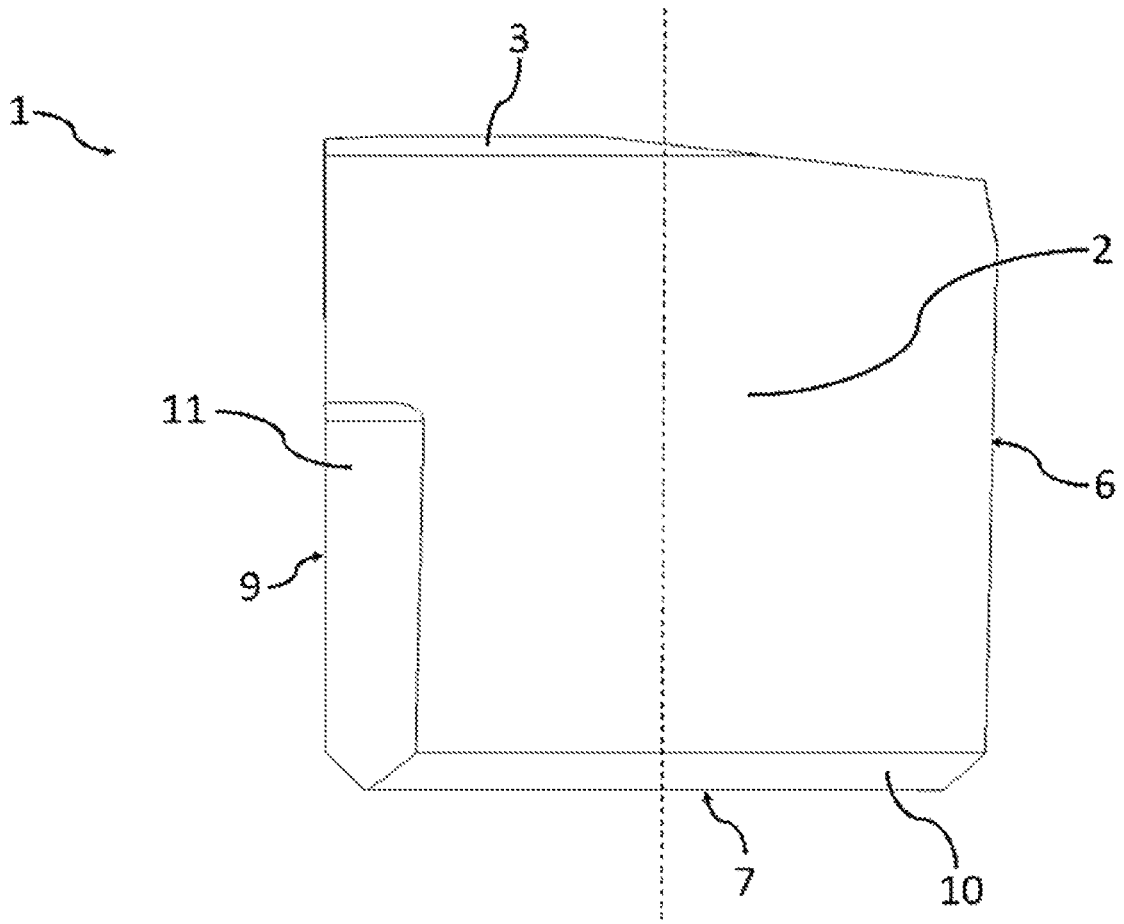
FIG. 3 is a side view of a die embodiment.

In some embodiments, the inclined groove 75 is a plane surface being parallel with an axis perpendicular to the central axis, as shown in FIG. 2 and FIG. 3, of the die 1. The angle of inclination is preferably 2°-20°. The inclined plane surface helps to provide a force in an upward direction to drive out the die 1 from a die holder. The tool preferably has a tip with an inclination angle matching the inclination angle of the plane surface of the groove 75.

FIG. 2 is a side view of a die 1 embodiment having a conical shaped side surface 6. The figure illustrates the body 2 of the die 1 when viewed directly towards the second portion 9 of the side surface 6. The second portion has a recess 5, which merges into the groove 4 on the top surface 3 of the die 1. The recess 5 is substantially round, shaped so at to form half of the head of a nail or screw. On the side surface 6 of the body 2 of the die 1, a first chamfered portion 11 and a second chamfered portion 11' is positioned, interconnecting the first portion of the side surface 6 with the second portion 9. The side surface 6 of the die 1 is angled, suitable for press fitting into a corresponding shape of an associated die holder. The angle of the side surface 6 with a central axis (dotted line) of the body 2 is between one and two degrees in this particular embodiment, but could be in the range of a tenth of a degree to 5 degrees. The bottom surface 7 of the die 1 is chamfered 10 for easy insertion and guiding of the die 1 into the die holder. In some embodiments of the die 1, the first and second chamfered portions 11, 11' extends from the bottom surface 7 to the top surface 3 of the die 1. On the bottom surface 7, a groove 75 has been cut into the body 2 of the die 1, extending from the bottom surface 7 to the second portion 9 of the side surface 6.

FIG. 3 is another side view of a die 1 embodiment having a conical shaped side surface 6. The figure illustrates the body 2 of the die 1 when viewed perpendicular, relative to the second portion 9 of the side surface 6. On the side surface 6 of the body 2 of the die 1, a first chamfered portion 11 and a second chamfered portion (not shown) is positioned, interconnection the first portion of the side surface 6 with the second portion 9. The side surface 6 of the die 1 is angled, suitable for press fitting into a corresponding shape of an associated die holder. The angle of the side surface 6 with a central axis (dotted line) of the body 2 is between one and two degrees in this particular embodiment, but could be in the range of a tenth of a degree to 5 degrees. The bottom surface 7 of the die 1 is chamfered 10 for easy insertion and guiding of the die 1 into the die holder.

Figure 4:
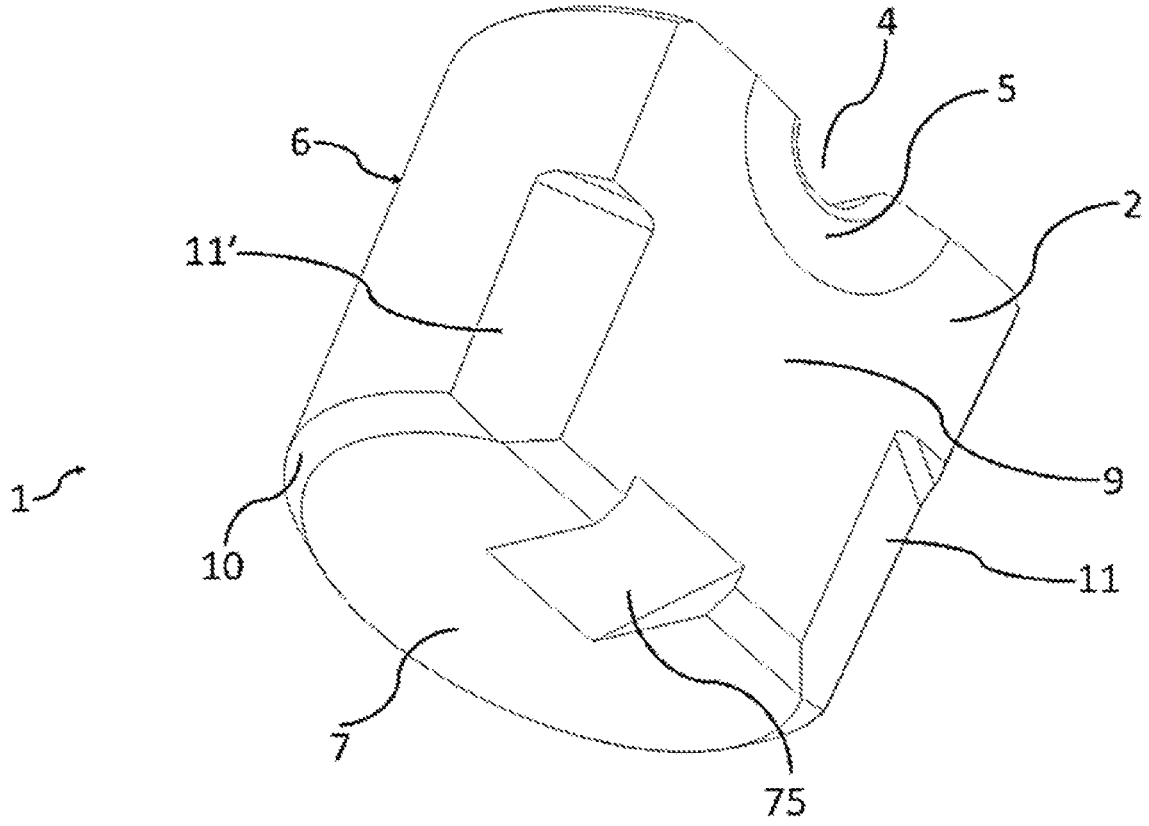
FIG. 4 is another trimetric view of a die embodiment.

FIG. 4 is another trimetric bottom view of a die 1 embodiment. The figure illustrates a die 1 for mounting in an associated die holder (not shown) for the production of heads on elongate bodies, such as a metal nail or screw. The body 2 of the die 1 has a side surface 6 comprising a first, substantially round portion and a second portion 9. The second portion 9 has a recess 5, shaped to form half of the head on the elongate body. The side surface 6 is shaped for press fit by contact with an inner surface of a bore or hole in the associated die holder. The die 1 has a bottom surface 7 with a chamfer 10 for easy mounting of the die 1 into the hole or bore of the associated die holder. The second portion 9 of the side surface 6 is flat for higher durability and furthermore serves to engage with a corresponding flat surface of the associated die holder, in order to fix angular orientation of the die 1, relative to the associated die holder. On the side surface 6 of the body 2 of the die 1, a first chamfered portion 11 and a second chamfered portion 11' is positioned, interconnecting the first portion of the side surface 6 with the second portion 9. On the bottom surface 7, a groove 75 has been cut into the body 2 of the die 1, extending to the second portion 9 of the side surface 6.

Figure 5:
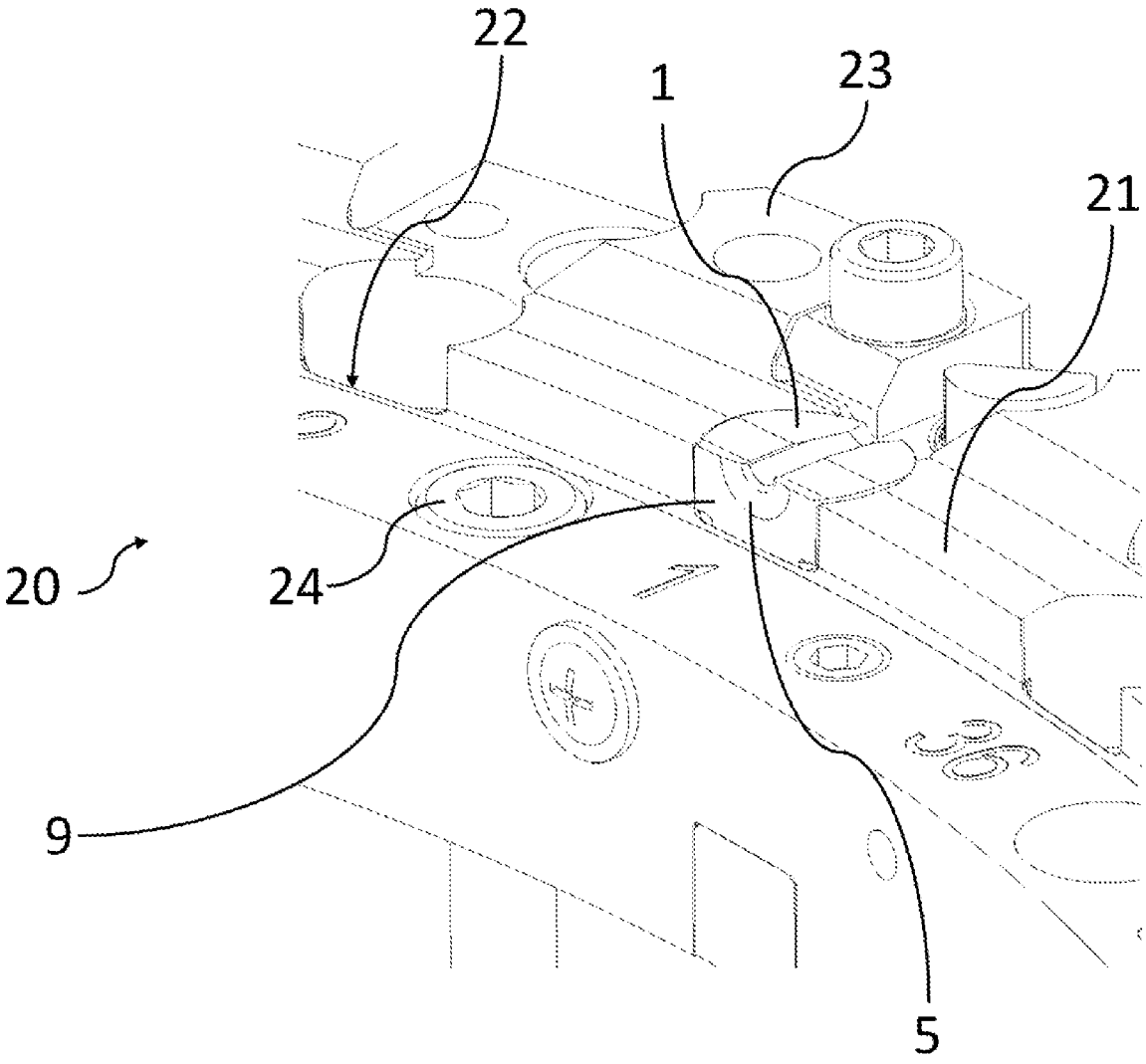
FIG. 5 is a trimetric view of a die holder with a mounted die embodiment.

FIG. 5 is a trimetric view of a section of a die holder 20 with a mounted die 1. The figure illustrates a mounted die 1 and a section of a rings-shaped die holder 20. A side surface 22 (not visible) of the die holder 20 is furthermore plane in respect to the second portion 9 of the side surface of the die 1, wherein the recess 5 of the die 1 for shaping the head of the elongate body is placed. On a third surface 23 of the die holder 20, parallel to the top surface 21 of the die holder 20, a pin or bolt 24 is seated for mounting the die holder 20 to a machine (not shown).

Figure 6:
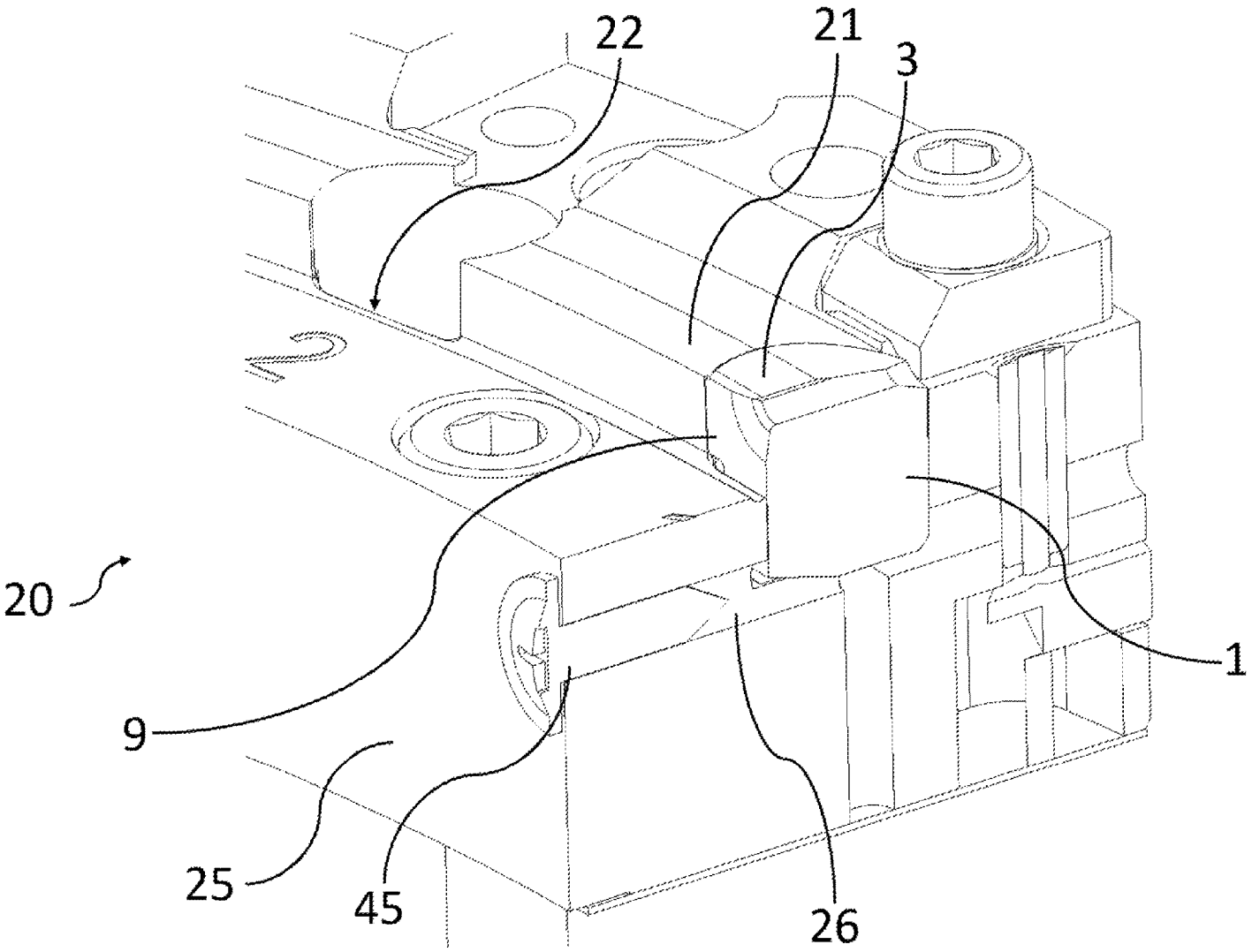
FIG. 6 is a trimetric view of a cross-section of a die holder and a mounted die embodiment.

FIG. 6 is a trimetric view of a section of a die holder 20 with a mounted die 1. The figure illustrates a section of a rings-shaped die holder 20 with a cross-section view of the die holder 20 and a mounted die 1. The top surface 3 of the die 1 and the top surface part 21 of the die holder 20 are plane in respect to each other. A side surface 22 (not visible) of the die holder 20 is furthermore plane in respect to the second portion 9 of the side surface of the die 1, wherein the recess 5 of the die 1 for shaping the head of the elongate body is placed. On the inner side 25 of the die holder 20, an opening 26 is located, the opening 26 extending to the bottom surface 7 of the die 1. In this particular embodiment, a plug 45 has been inserted into the opening 26 of the die holder 20.

Figure 7:
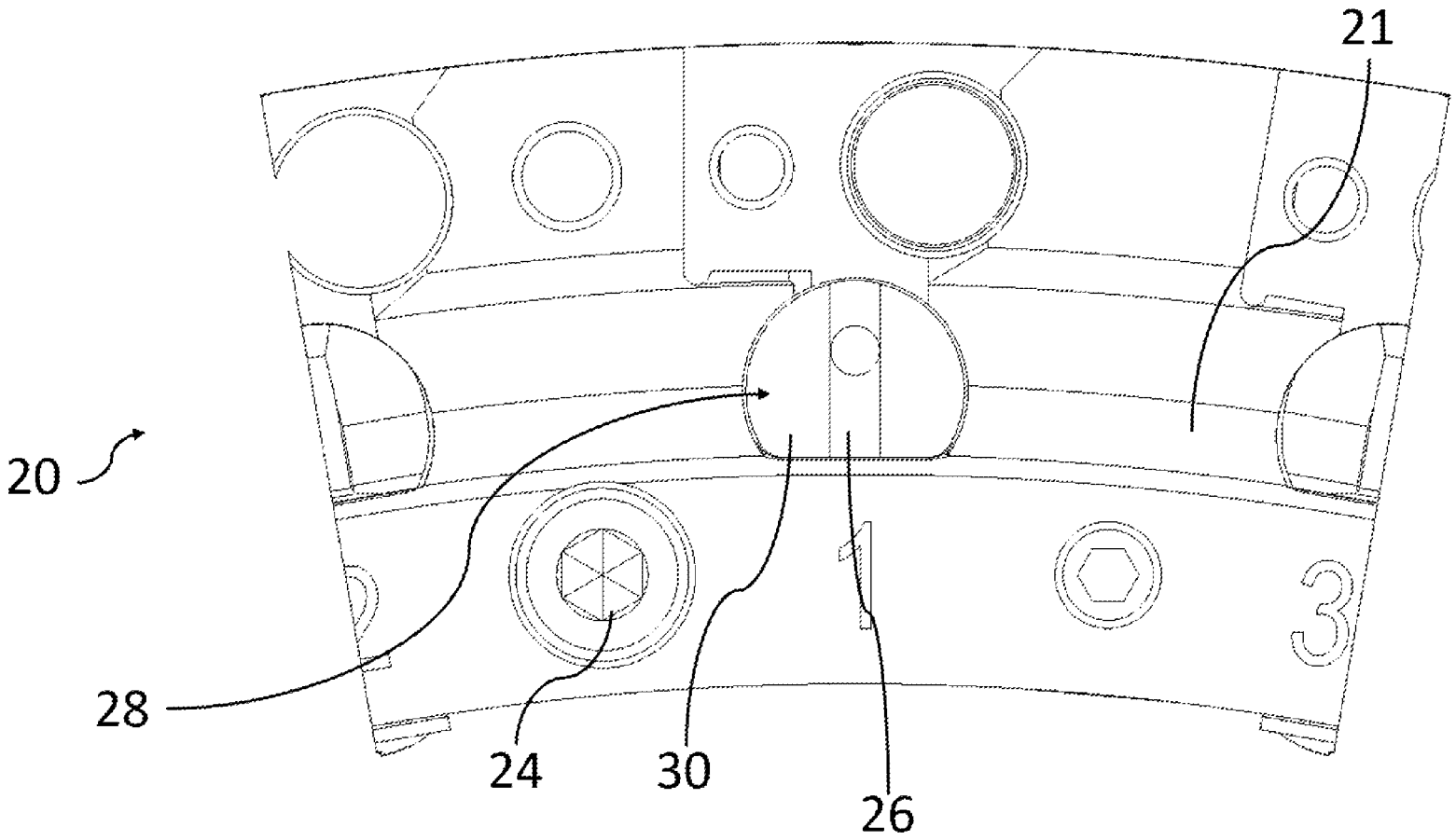
FIG. 7 is a top view of a section of a die holder embodiment.

FIG. 7 is a top view of a section of a ring-shaped die holder 20, according to the invention. In the middle of the figure, the bore 30 in the top surface 21 of the die holder 20 is located. In the bottom surface 28 of the die holder 20, the opening 26 of die holder 20 is visible. On a third surface 23 of the die holder 20, parallel to the top surface 21, a pin or bolt 24 is seated for mounting the die holder 20 to a machine (not illustrated).

Preferably, the die holder 20 is a monolithic element made of metal, preferably a metal, which is softer than the metal or other material which forms the associated dies to be press fit in the holes or bores 30. The dies are preferably made of a hard material, e.g. a hard metal, to provide a long lifetime. By the press fitting principle, the hard material die is securely fastened in the hole or bore 30, thus providing optimal support of the edge of the hard material die, thereby providing a long life time of the die.

The holes or bores 30 each has an inner surface shaped for receiving a die and for press fit by contact with the side surface of the die. In the hole or bore 30, a stop part is formed so as to allow engagement with a stop surface of the die when the die is being pressed into the hole or bore, so as to fix a height of a top surface of the die in relation to the top surface part of the die holder 20. Further, the die holder 20 has a protrusion or recess serving to engage with a corresponding recess or protrusion of the die, in order to fix angular orientation of the die relative to the die holder, thereby facilitating precise angular orientation of the die during the mounting in the die holder 20, e.g. after replacement of the die.

Figure 8:
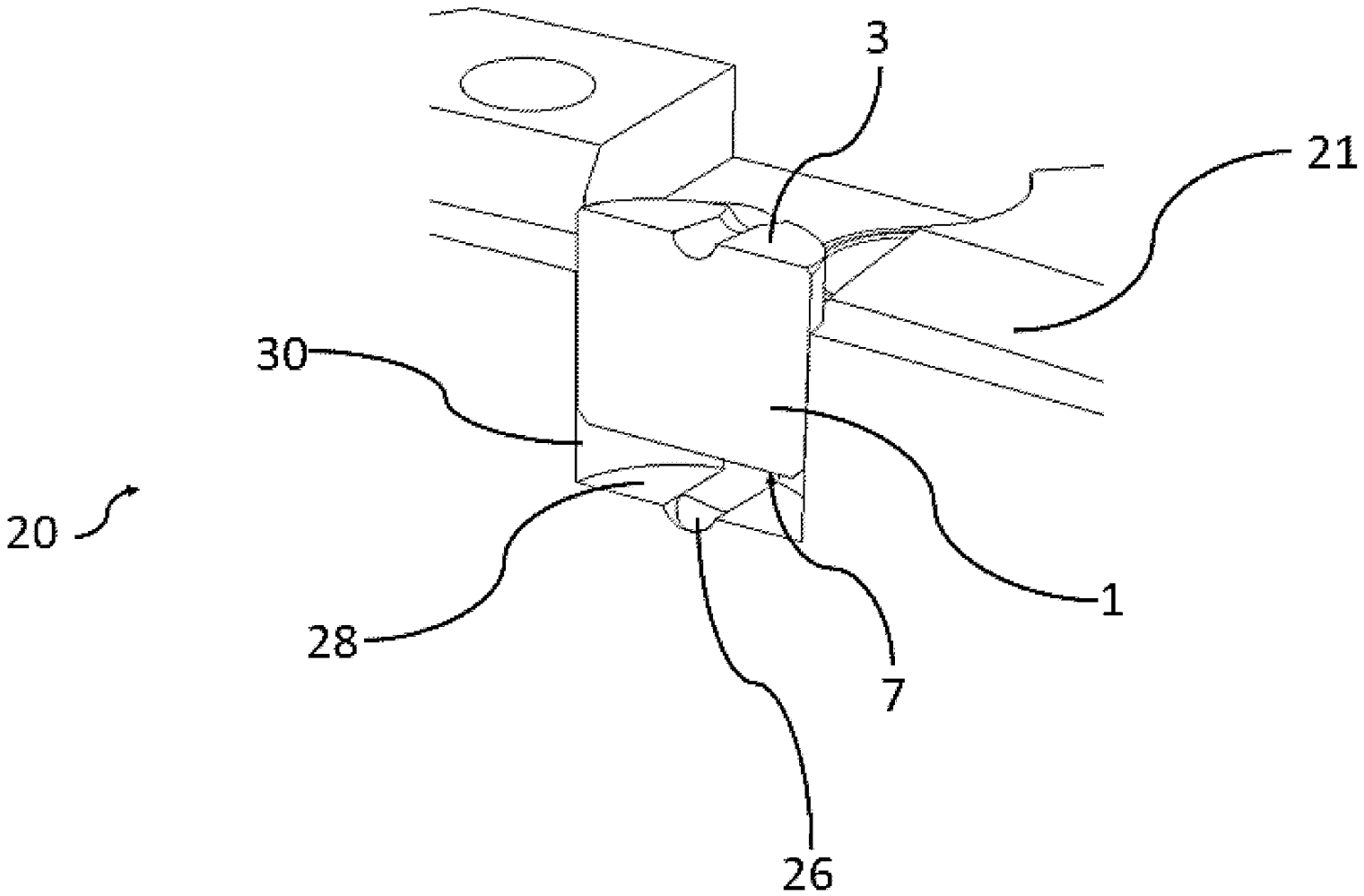
FIG. 8 is a trimetric view of a cross-section of a die holder and an unmounted die embodiment.

FIG. 8 is a trimetric view of a section of a die holder 20 with an unmounted die 1. The figure illustrates a section of a rings-shaped die holder 20 with a cross-section view of the die holder 20 and an unmounted die 1, floating above a bore 30 in the top surface 21 of the die holder 20. The floating die 1 has a bottom surface 7 corresponding to a bottom surface 28 of the die holder 20. The top surface 3 of the die 1 and the surface part 21 of the die holder 20 are plane in respect to each other when the stop or bottom surface 7 of the die 1 is abutting the bottom surface 28 of the die holder 20.

Figure 9:
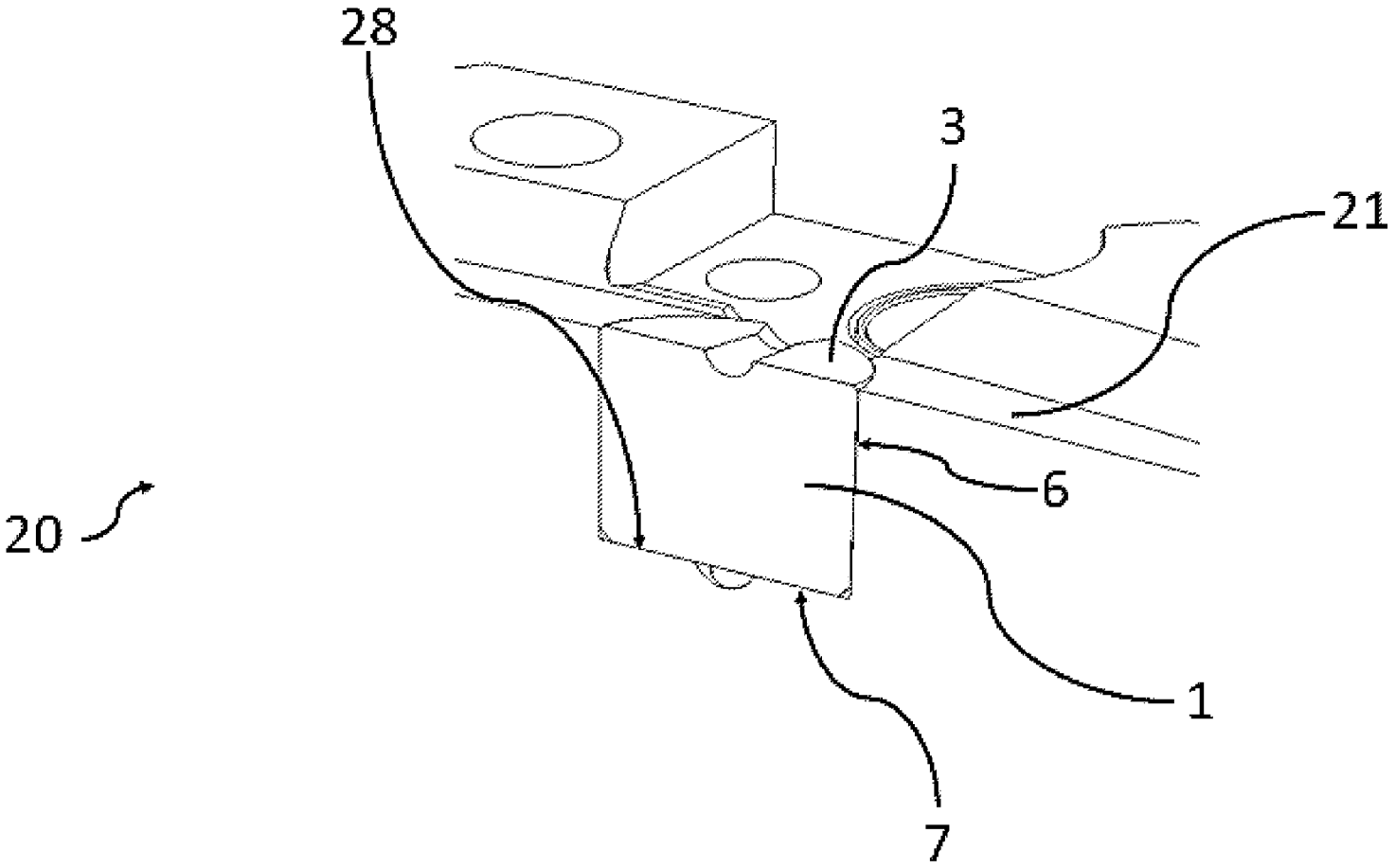
FIG. 9 is a trimetric view of a cross-section of a die holder and amounted die embodiment.

FIG. 9 is a side view of a cross-section of a die holder 20 and die 1, the die 1 mounted into the bore in the die holder 20. The die 1 has a side surface 6 shaped for press fit by contact with a corresponding inner surface of the bore in the die holder 20. The press fit serves to interlock the die 1 within the bore 30 of the die holder 20. When the bottom surface 7 of the die 1 abuts with the bottom surface 28 of the die holder 20, the top surface 3 of the die 1 becomes flush or plane with the top surface 21 of the die holder 20.

Figure 10:
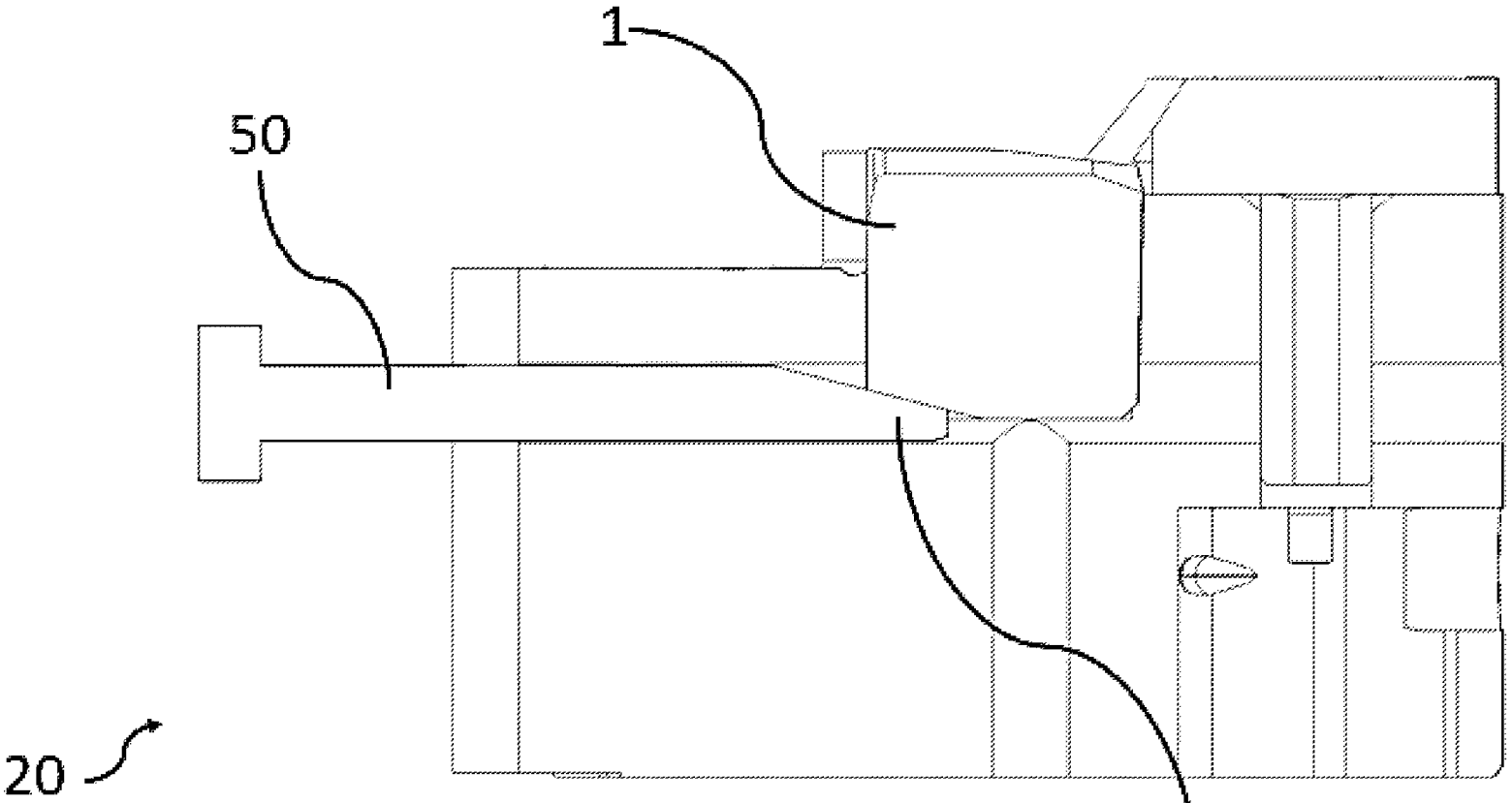
FIG. 10 is a side view of a cross-section of an elongate tool, placed in an opening of a die holder, between the die holder and a die, according to an embodiment.

FIG. 10 is a side view of a cross-section of an elongate tool 50, placed in an opening of a die holder 20, between the die holder 20 and a die 1, according to the invention. The elongate tool has a tapered tip 52 abutting the bottom surface 7 of the die 1. When the elongate tool 50 is forced towards the die 1, the die 1 is forced away from the die holder 20, releasing the die 1 from the die holder 20 for maintenance of the die holder 20 or die 1.

Figure 11:
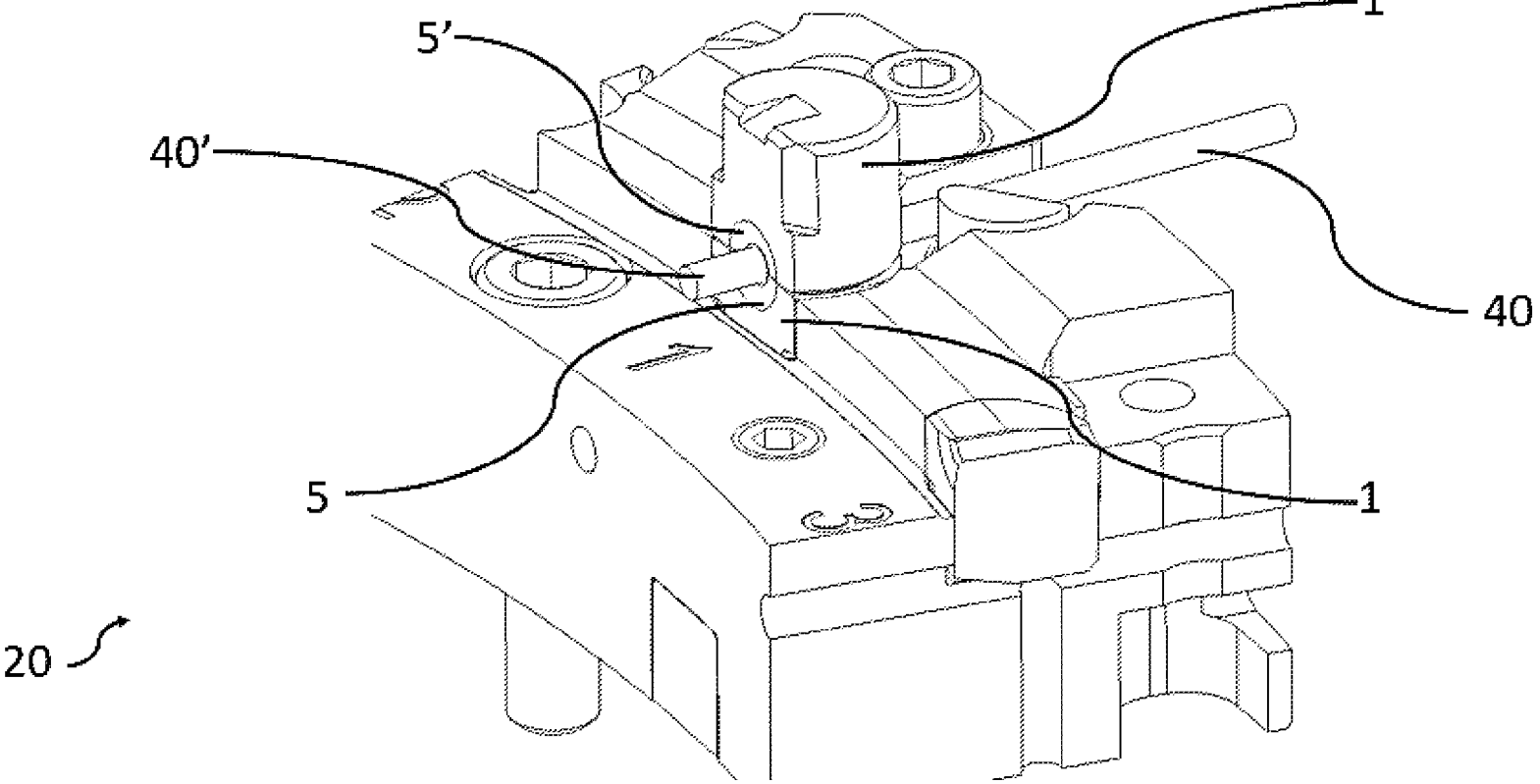
FIG. 11 is a trimetric view of an elongate body fixed between two corresponding dies and a section of a die holder.

FIG. 11 is a trimetric view of an elongate body 40 fixed between two corresponding dies 1, 1' and a section of a ring-shaped die holder 20. The recesses 5, 5' on each die 1, 1' forms the shape of the head of a nail, when the two dies 1, 1' are positioned with their corresponding top surfaces facing towards each other and their grooves aligned and the head end 40' of the elongate body 40 is pressed in a longitudinal direction, towards the recesses 5, 5' of the dies 1, 1'.

Figure 12:
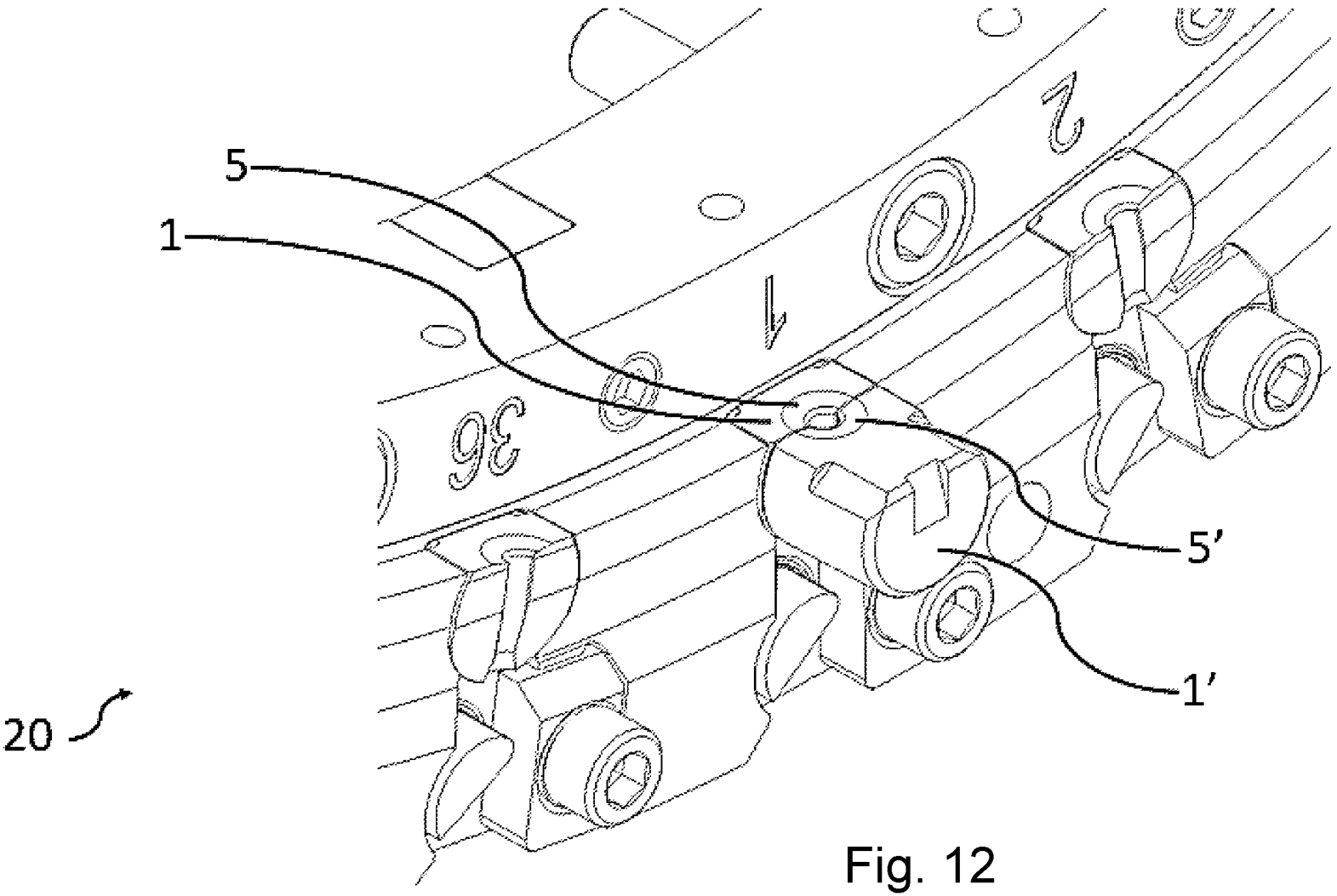
FIG. 12 is trimetric view of a section of a ring-shaped die holder with a mounted die and a corresponding, free-floating die to illustrate cooperation of recesses of two dies for producing a head on a nail.

FIG. 12 is a trimetric view of two corresponding dies 1, 1' and a section of a ring-shaped die holder 20. In the illustration, one die 1 is mounted in the die holder 20 and the second die 1' is floating, as how it would be mounted in a second die holder (not shown), and wherein the top surfaces of the dies 1, 1' are abutting each other. The recesses 5, 5' on each die 1, 1' forms the shape of the head of a nail, when the two dies 1, 1' are positioned with their corresponding top surfaces facing towards each other and their grooves are aligned.

Figure 13:
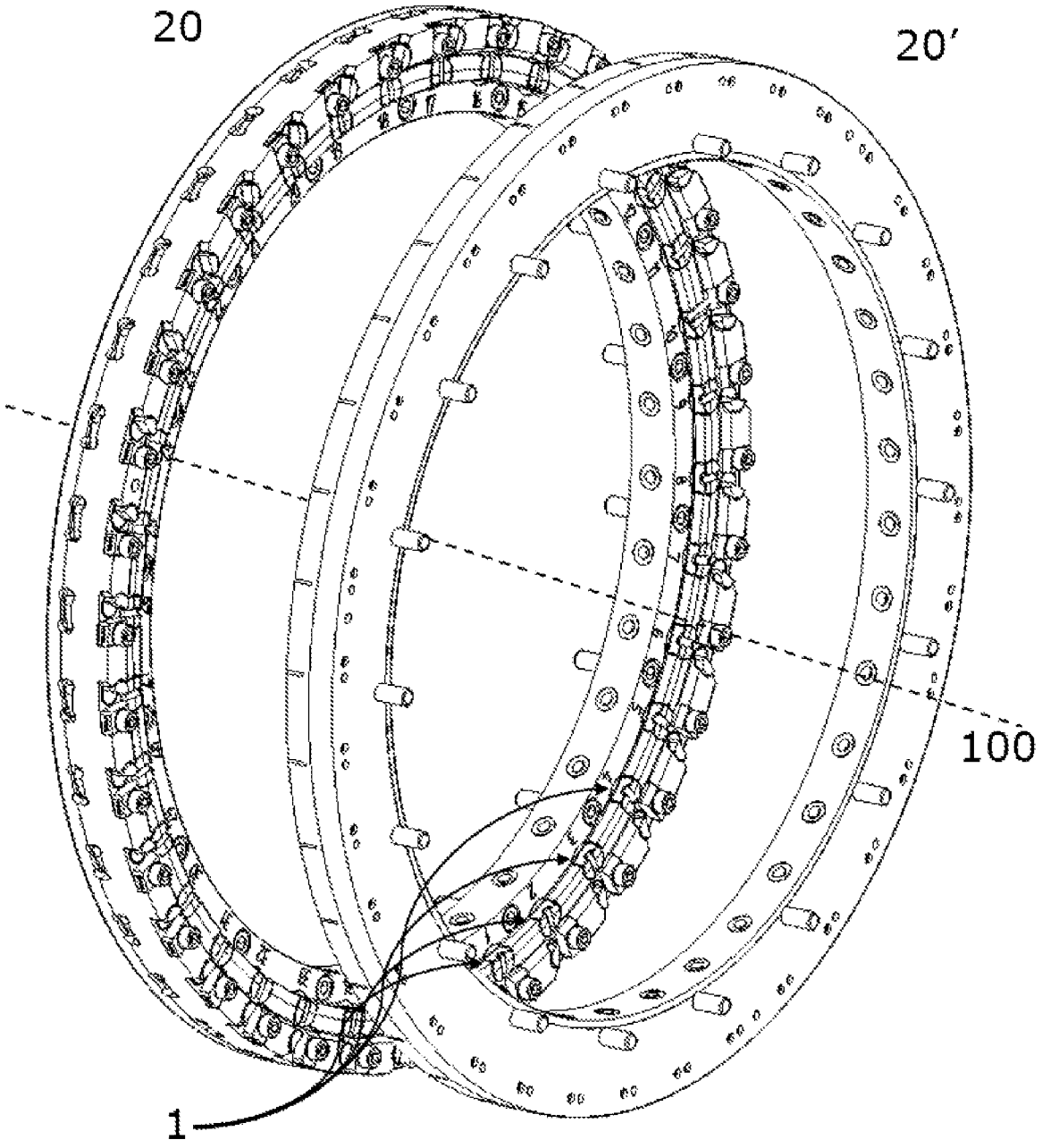
FIG. 13 is a side view of two ring-shaped die holders oriented towards each other, such as for forming part of a nail, in a nail producing machine.

FIG. 13 is a trimetric view of two ring-shaped die holder embodiments 20, 20' oriented towards each other. The ring-shaped die holders 20, 20' have a central axis of rotation 100, about which they are arranged to rotate. A plurality of dies 1 are positioned within the die holders 20, 20' around the circumference. The dies 1 are mounted on each of the die holders 20, 20' are arranged facing towards each other. Especially, one of the die holders 20, the bores or holes for the dies are parallel with the axis of rotation 100, while on the other die holder 20', the bores or holes for the dies are slightly angled. It is to be understood, that the position and angle of the die holders 20, 20' are configured so as to be closer at one point, such as at the bottom portions, than at the top portions, to enable the plurality of dies 1 of a first die holder 20, to abut with corresponding dies of the opposite die holder 20'.

Figure 14:
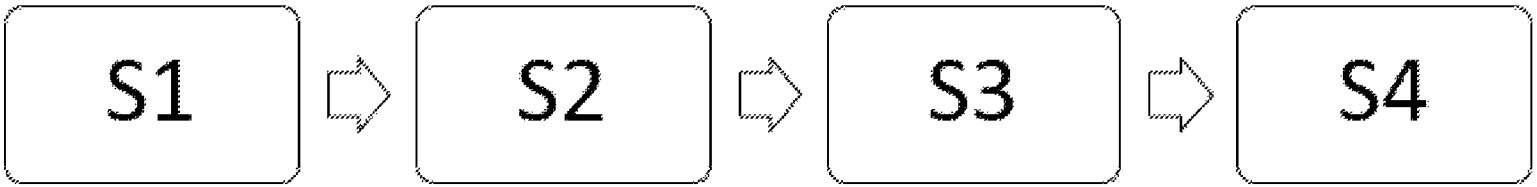
FIG. 14 is a flow-chart of a method according to the invention.

FIG. 14 is a flow-chart of a method embodiment for manufacturing a head on an elongate body, such as metal nails or screws, the method comprising:

e. providing S1 first and second die holders 20, 20', each of the first and second die holders comprising:
   - i. a body having at least a surface part 21,
   - ii. a hole or bore 30 in the surface part, wherein the hole or bore has a first inner surface portion 29 with a curved shaped and arranged for receiving the die and for press fit by contact with a first side surface portion 6 of the die,
   - iii. a stop part 28 located in the hole or bore for engaging with a bottom surface 7 of the die when being pressed into the hole or bore, so as to fix a height of the top surface 3 of the die in relation to the surface part of the die holder, and
   - iv. a second inner surface portion of the bore or hole engaging with a corresponding second side surface portion of the die, in order to fix angular orientation of the groove 4 of the die relative to the die holder, f. providing S2 first and second dies 1, 1', each of the first and second dies comprising:
   - vi. a body 2 with a top surface provided with a through-going groove for receiving and holding an elongate body longitudinally in said groove,
   - vii. a recess 5 at one end of the groove suitable for forming the head on the elongate body,
   - viii. a first side surface portion with a curved shape for press fit by contact with a first inner surface portion of a bore or hole in the associated die holder,
   - ix. a stop surface for engaging with a stop part in the hole or bore of the associated die holder, so as to determine a height of the top surface of the die in relation to a surface part of the associated die holder, and
   - x. a second side surface portion serving to engage with the corresponding second inner surface portion of the die holder, in order to fix angular orientation of the groove relative to the die holder, g. bringing S3 the top surface of the first die 1 so near to the top surface of the second die 1' that the grooves of the first and second dies hold the elongate body, and h. providing S4 force onto the elongate body at the recess end of the grooves so as to form a head on the elongate body.

Figure 15A:
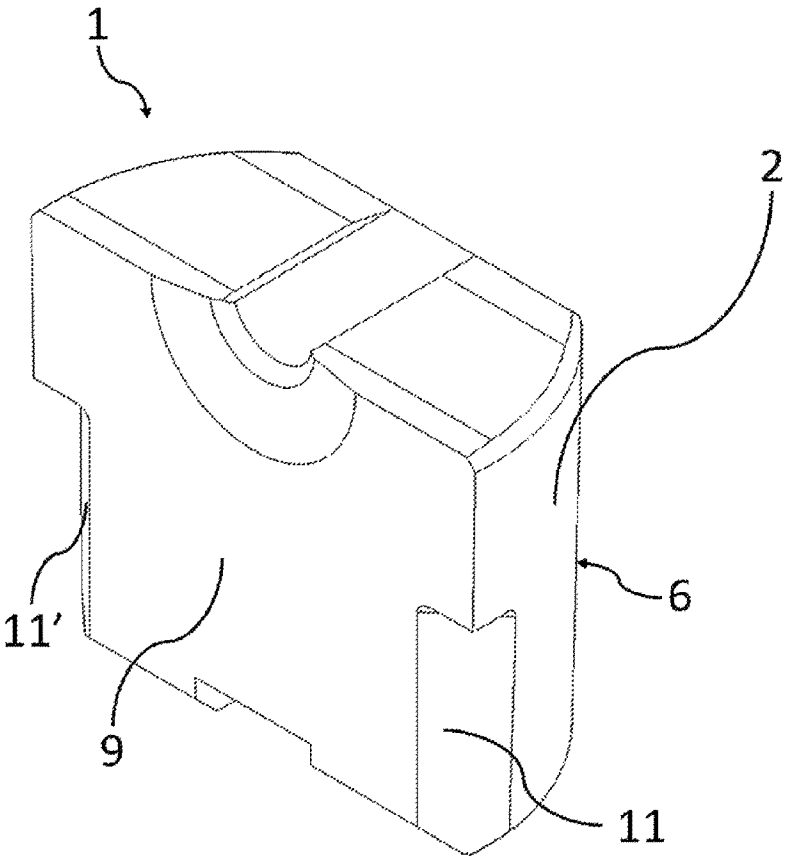
FIG. 15*a* and FIG. 15*b* are trimetric views of alternative die embodiments.
Figure 15B:
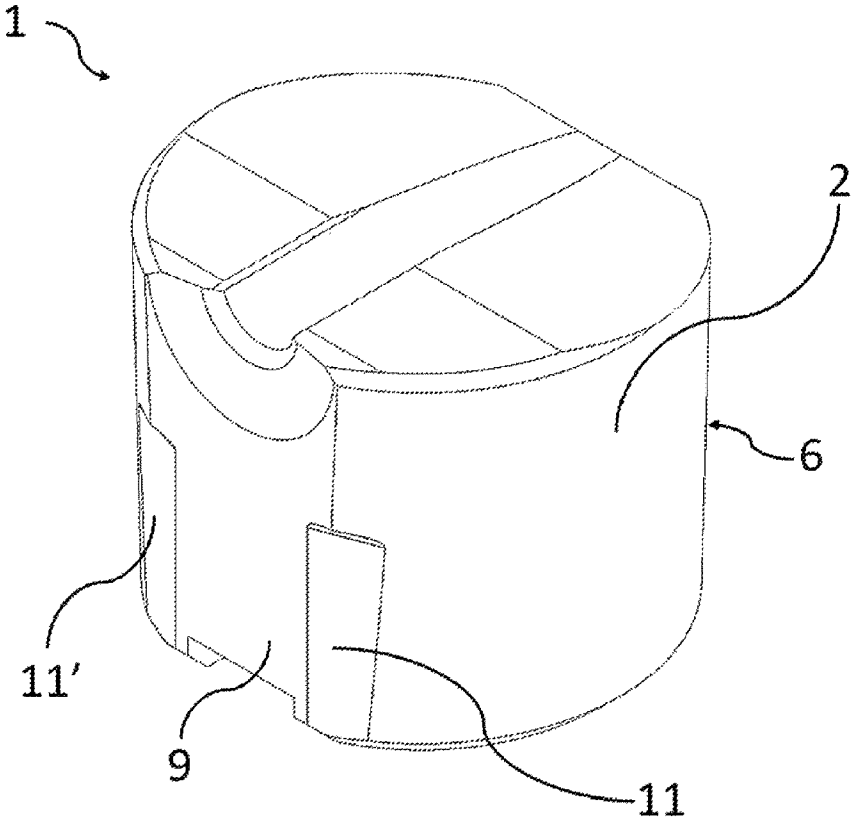

FIG. 15*a* and FIG. 15*b* are trimetric views of alternative die embodiments.

FIG. 15*a* is a trimetric view of a die 1 embodiment. The figure illustrates a die 1 for mounting in an associated die holder (not shown) for the production of heads on elongate bodies, such as a metal nail or screw. The die 1 comprises a body 2 with has a side surface 6 comprising a first, substantially round portion and a second portion 9. The second portion 9 has a large surface area relative to some embodiments of the die 1. The side surface 6 is shaped for press fit by contact with an inner surface of a bore or hole in the associated die holder. The second portion 9 of the side surface 6 is flat for higher durability and furthermore serves to engage with a corresponding flat surface of the associated die holder, in order to fix angular orientation of the die 1, relative to the associated die holder. On the side surface 6 of the body 2 of the die 1, a first chamfered portion 11 and a second chamfered portion 11' is positioned, interconnecting the first portion of the side surface 6 with the second portion 9. In some embodiments of the die 1, the first and second chamfered portions 11, 11' extends from a bottom surface to a top surface of the die 1.

FIG. 15*b* is a trimetric view of a die 1 embodiment. The figure illustrates a die 1 for mounting in an associated die holder (not shown) for the production of heads on elongate bodies, such as a metal nail or screw. The die 1 comprises a body 2 with has a side surface 6 comprising a first, substantially round portion and a second portion 9. The second portion 9 has a small surface area relative to some embodiments of the die 1. The side surface 6 is shaped for press fit by contact with an inner surface of a bore or hole in the associated die holder. The second portion 9 of the side surface 6 is flat for higher durability and furthermore serves to engage with a corresponding flat surface of the associated die holder, in order to fix angular orientation of the die 1, relative to the associated die holder. On the side surface 6 of the body 2 of the die 1, a first chamfered portion 11 and a second chamfered portion 11' is positioned, interconnecting the first portion of the side surface 6 with the second portion 9. In some embodiments of the die 1, the first and second chamfered portions 11, 11' extends from a bottom surface to a top surface of the die 1.

Figure 16A:
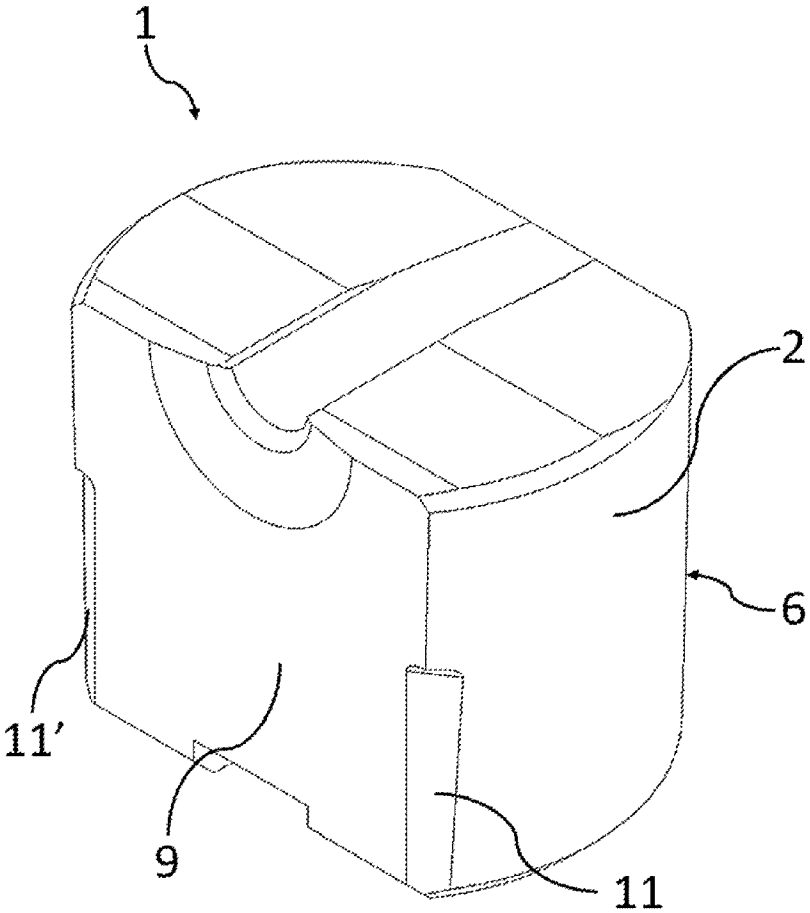
FIG. 16*a* and FIG. 16*b* are trimetric views of other alternative die embodiments.
Figure 16B:
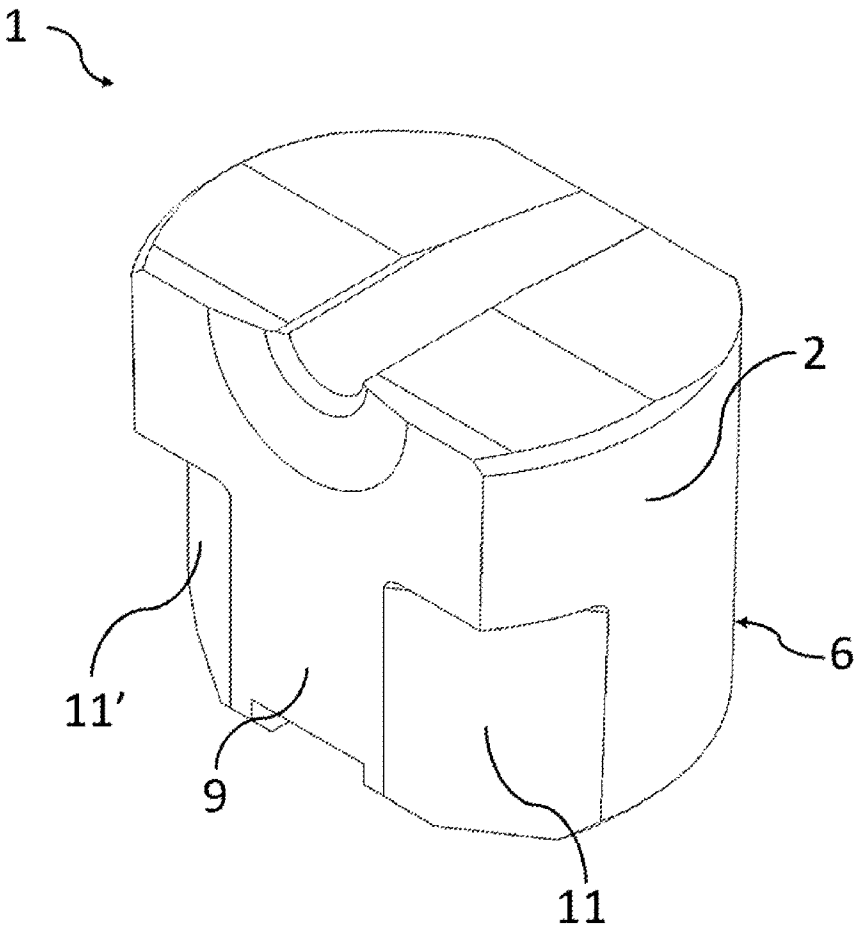

FIG. 16*a* and FIG. 16*b* are trimetric views of other alternative die embodiments.

FIG. 16*a* is a trimetric view of a die 1 embodiment. The figure illustrates a die 1 for mounting in an associated die holder (not shown) for the production of heads on elongate bodies, such as a metal nail or screw. The die 1 comprises a body 2 with has a side surface 6 comprising a first, substantially round portion and a second portion 9. The second portion 9 has a large surface area relative to some embodiments of the die 1. The side surface 6 is shaped for press fit by contact with an inner surface of a bore or hole in the associated die holder. The second portion 9 of the side surface 6 is flat for higher durability and furthermore serves to engage with a corresponding flat surface of the associated die holder, in order to fix angular orientation of the die 1, relative to the associated die holder. On the side surface 6 of the body 2 of the die 1, a first chamfered portion 11 and a second chamfered portion 11' is positioned, interconnecting the first portion of the side surface 6 with the second portion 9. The chamfered portions have a small surface area, relative to some embodiments of the die 1. In some embodiments of the die 1, the first and second chamfered portions 11, 11' extends from a bottom surface to a top surface of the die 1.

FIG. 16*b* is a trimetric view of a die 1 embodiment. The figure illustrates a die 1 for mounting in an associated die holder (not shown) for the production of heads on elongate bodies, such as a metal nail or screw. The die 1 comprises a body 2 with has a side surface 6 comprising a first, substantially round portion and a second portion 9. The side surface 6 is shaped for press fit by contact with an inner surface of a bore or hole in the associated die holder. The second portion 9 of the side surface 6 is flat for higher durability and furthermore serves to engage with a corresponding flat surface of the associated die holder, in order to fix angular orientation of the die 1, relative to the associated die holder. On the side surface 6 of the body 2 of the die 1, a first chamfered portion 11 and a second chamfered portion 11' is positioned, interconnecting the first portion of the side surface 6 with the second portion 9. The chamfered portions have a large surface area, relative to some embodiments of the die 1. In some embodiments of the die 1, the first and second chamfered portions 11, 11' extends from a bottom surface to a top surface of the die 1.

Figure 17A:
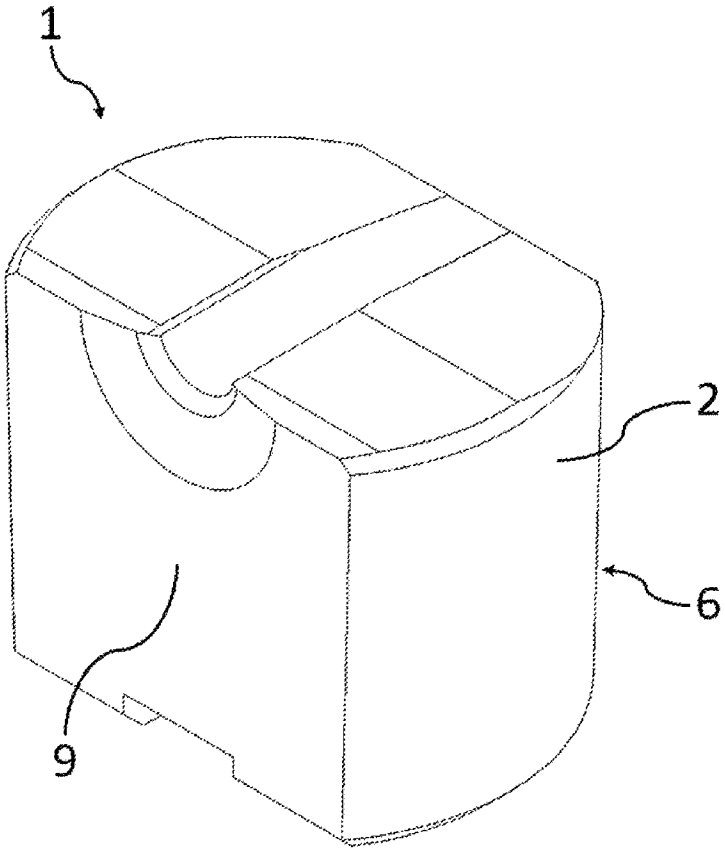
FIG. 17*a* and FIG. 17*b* are trimetric views of yet other alternative die embodiments.
Figure 17B:
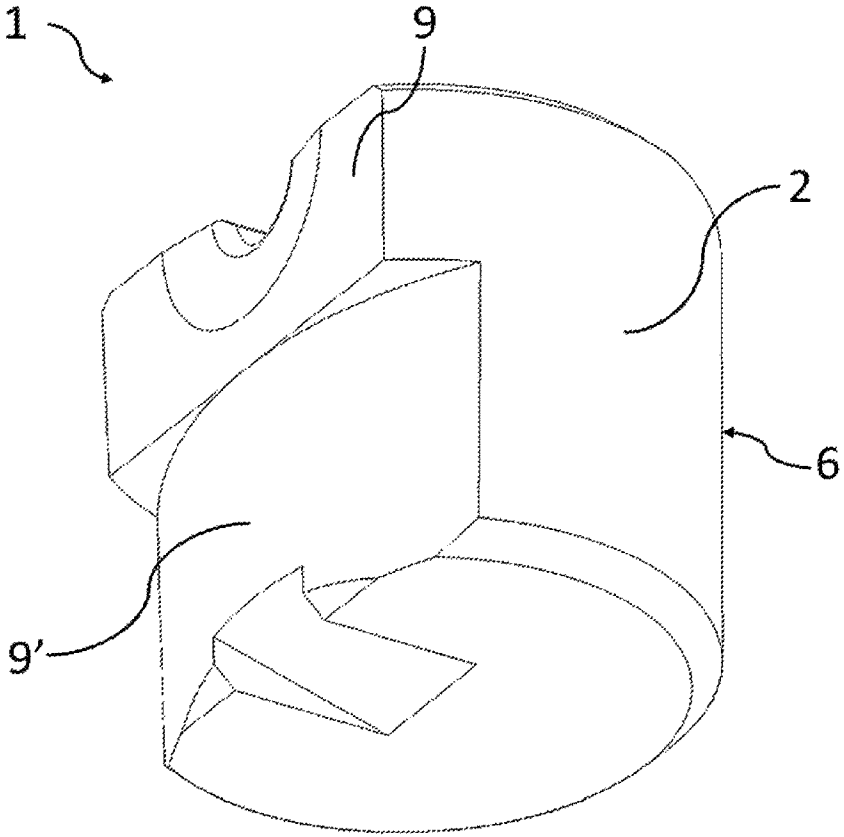

FIG. 17*a* and FIG. 17*b* are trimetric views of yet other alternative die embodiments.

FIG. 17*a* is a trimetric view of a die 1 embodiment. The figure illustrates a die 1 for mounting in an associated die holder (not shown) for the production of heads on elongate bodies, such as a metal nail or screw. The die 1 comprises a body 2 with has a side surface 6 comprising a first, substantially round portion and a second portion 9. The side surface 6 is shaped for press fit by contact with an inner surface of a bore or hole in the associated die holder. The second portion 9 of the side surface 6 is flat for higher durability and furthermore serves to engage with a corresponding flat surface of the associated die holder, in order to fix angular orientation of the die 1, relative to the associated die holder.

FIG. 17*b* is a trimetric view of a die 1 embodiment. The figure illustrates a die 1 for mounting in an associated die holder (not shown) for the production of heads on elongate bodies, such as a metal nail or screw. The die 1 comprises a body 2 with has a side surface 6 comprising a first, substantially round portion, a second portion 9 and a third portion 9'. The side surface 6 is shaped for press fit by contact with an inner surface of a bore or hole in the associated die holder. The second portion 9 of the side surface 6 is flat for higher durability during nail production. The third portion 9' of the side surface 6 is curved and serves to engage with a corresponding curved surface of the associated die holder, in order to fix angular orientation of the die 1, relative to the associated die holder. In some embodiments, the curvature of the side surface 6 and the curvature of the third portion 9' are substantially identical. In this particular embodiment, the curvature of the side surface 6 and the curvature of the third portion 9' are different.

To sum up, the invention provides a die 1 for mounting in an associated die holder 20 for the production of heads on elongate bodies such as nails or screws. The die has a body 2 with a top surface 3 provided with a through-going groove 4 for receiving and holding an elongate body longitudinally in said groove. Furthermore, the die has a recess 5 on one side merging into the groove 4 at one end of the groove 4 suitable for forming the head of a nail or screw. The die has a side surface portion, e.g. conical, shaped for press fit by contact with a corresponding inner surface portion of a bore or hole 30 in the associated die holder. Further, a second side surface portion (9), e.g. a plane portion, of the die serves to engage with a corresponding inner surface portion of the bore or hole of the die holder. Hereby, it is ensured, that angular orientation of the groove 4 is fixed relative to the die holder 20, and it has been proven that the two different side surface portions of the die, e.g. with a conical portion and a plane portion, provides an efficient press fit which ensures a long lifetime of the die. Further, the die is very simple to mount in the die holder, e.g. by hand, and it is simple to eject by a tool. Thus, altogether a highly efficient nail production can be obtained with such die and die holder system.

Although the present invention has been described in connection with the specified embodiments, it should not be construed as being in any way limited to the presented examples. The scope of the present invention is set out by the accompanying claim set. In the context of the claims, the terms "comprising" or "comprises" do not exclude other possible elements or steps. Also, the mentioning of references such as "a" or "an" etc. should not be construed as excluding a plurality. The use of reference signs in the claims with respect to elements indicated in the figures shall also not be construed as limiting the scope of the invention. Furthermore, individual features mentioned in different claims, may possibly be advantageously combined, and the mentioning of these features in different claims does not exclude that a combination of features is not possible and advantageous.

The invention claimed is:

1. A die (1) for mounting in an associated die holder for the production of heads on elongate bodies (40), the die comprising:

a body (2) with a top surface (3) provided with a through-going groove (4) for receiving and holding an elongate body longitudinally in said groove, a recess (5) at one end of the groove suitable for forming the head on the elongate body, a side surface (6) comprising a first portion with a curved shaped arranged for press fit by contact with a curved portion of an inner surface (29) of a bore or hole (30) in the associated die holder, and a stop surface (7) for engaging with a stop part (28) in the hole or bore of the associated die holder, so as to determine a height of the die in relation to the associated die holder, wherein the side surface further comprises a second portion (9) shaped to engage with a corresponding portion of the inner surface of the bore or hole in the associated die holder, in order to guide angular orientation of the groove relative to the associated die holder, wherein the first portion of the side surface has a cylindrical shape or a conical shape, wherein the second portion of the side surface comprises a plane portion configured to engage with a corresponding plane portion of the inner surface of the bore or hole in the associated die holder, and wherein said plane portion forms an angle of 0.5-2.0° with a central axis of the die.

2. The die according to claim 1, wherein said second portion of the side surface is further arranged for press fit by contact with the corresponding portion of the inner surface (29) of the bore or hole (30) in the associated die holder.

3. The die according to claim 1, wherein an area of the second portion of the side surface is smaller than an area of the first portion of the side surface, such as the area of the second portion of the side surface being 10-40% of an area of the first portion of the side surface.

4. The die according to claim 1, wherein the side surface has chamfered portions interconnecting said first and second portions of the side surface.

5. The die according to claim 1, wherein a bottom part of the hole or bore of the associated die holder, is configured to receive an associated dummy element to engage with a bottom surface of the body of the die, so as to form the stop surface in cooperation with the bottom part of the hole or bore of the associated die holder.

6. A machine for producing heads on elongated bodies (40), the machine comprising at least one die according to claim 1.

7. The machine according to claim 6, comprising a head forming mechanism arranged to apply a force onto the elongate body at the recess end of the groove of the die, when the elongate body is fixated by the groove of the die, so as to form a head on the elongate body shaped according to the recess of the die.

8. The machine according to claim 6, wherein said first portion of the side surface of the at least one die has a conical shape, wherein the conical shaped portion of the side surface forms a first angle relative to a central axis of the die, and wherein each of the plurality of holes or bores (30) of the die holder has a first inner side surface portion with a conical shape which forms a second angle relative to a central axis of the holes or bores.

9. The machine according to claim 8, wherein the first angle is larger than the second angle, such as the first angle being 0.02°-0.10° larger than the second angle.

* * * * *